US007240875B2

(12) United States Patent
Hernández et al.

(10) Patent No.: US 7,240,875 B2
(45) Date of Patent: Jul. 10, 2007

(54) YARN CARRIER

(75) Inventors: Ismael A. Hernández, Florence, SC (US); Brian P. Couchey, Inman, SC (US); Clifford A. Bellum, Hartsville, SC (US); Christoph Reicherz, Kötterichen (DE); Richard K. Mims, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 23 days.

(21) Appl. No.: 10/685,976

(22) Filed: Oct. 14, 2003

(65) Prior Publication Data

US 2005/0077421 A1 Apr. 14, 2005

(51) Int. Cl.
*B65H 75/10* (2006.01)
*B65H 75/28* (2006.01)

(52) U.S. Cl. ..... 242/587.2; 242/125.1; 242/610.1; 242/610.4

(58) Field of Classification Search ..... 242/125.1, 242/118.3, 118.32, 610, 610.1, 610.4, 610.6, 242/613, 579, 586, 586.2, 587.2, 587.3, 476.1, 242/476.5, 476.6
See application file for complete search history.

(56) References Cited

U.S. PATENT DOCUMENTS

| | | | | | |
|---|---|---|---|---|---|
| 1,074,590 | A | | 9/1913 | Kempshall | 29/895.21 |
| 1,919,769 | A | * | 7/1933 | Brown et al. | 242/613.5 |
| 1,991,880 | A | | 2/1935 | Chaffin | 242/164 |
| 2,615,651 | A | | 10/1952 | Johnson | 242/125.1 |
| 2,679,989 | A | * | 6/1954 | Dunlap | 242/118.31 |
| 2,930,537 | A | | 3/1960 | Davis et al. | 242/475 |
| 2,953,317 | A | | 9/1960 | Atwood et al. | 242/118.31 |
| 2,967,026 | A | * | 1/1961 | Van Deventer, III | 242/118.31 |
| 2,973,126 | A | | 2/1961 | Kresslein | 225/63 |
| 3,000,590 | A | | 9/1961 | Dunlap et al. | 242/118.31 |
| 3,032,292 | A | | 5/1962 | Levinson | 242/125.2 |
| 3,107,067 | A | | 10/1963 | Atwood et al. | 242/118.32 |
| 3,224,696 | A | * | 12/1965 | Hendry, Jr. | 242/597.6 |
| 3,300,159 | A | * | 1/1967 | Johnson et al. | 242/118.32 |
| 3,402,902 | A | | 9/1968 | Schmidt | 242/118.31 |
| 3,451,639 | A | | 6/1969 | Atwood et al. | 242/118.32 |

(Continued)

FOREIGN PATENT DOCUMENTS

CH 639 349 A 11/1983

(Continued)

*Primary Examiner*—William A. Rivera
*Assistant Examiner*—Scott Haugland
(74) *Attorney, Agent, or Firm*—DLA Piper US LLP

(57) ABSTRACT

A yarn carrier is provided in the form of a yarn winding tube having a yarn catch insert. The yarn winding tube is a hollow cylindrical tube having a longitudinal axis extending lengthwise between its first and second opposite ends. The tube has a hole through its surface for receiving a yarn catch insert. The yarn catch insert includes a first member and a second member, each having an inside surface. When positioned within the hole, the inside surfaces of the first and second members face each other and form a string-up groove therebetween. After a yarn winding and unwinding process, the yarn catch insert may be removed from the hole in the tube, the first and second member may be separated, and the string-up groove may be cleaned. The yarn catch insert may then be re-inserted into the hole and the tube may be reused for winding.

19 Claims, 13 Drawing Sheets

U.S. PATENT DOCUMENTS

| | | | | | |
|---|---|---|---|---|---|
| 3,563,490 | A | * | 2/1971 | Berger | 242/118.11 |
| 3,582,011 | A | | 6/1971 | Murray | 242/587.1 |
| 3,625,451 | A | | 12/1971 | Anderson | 242/125.1 |
| 3,628,747 | A | | 12/1971 | Bakewell | 242/118.32 |
| 3,707,854 | A | | 1/1973 | Matzel | 66/125 R |
| 3,730,447 | A | | 5/1973 | Franzen et al. | 242/476.4 |
| 3,743,210 | A | | 7/1973 | Hawley | 242/125.1 |
| 3,801,038 | A | | 4/1974 | Wust | 242/487.6 |
| 3,809,326 | A | | 5/1974 | Wüst | 242/487.6 |
| 3,814,347 | A | | 6/1974 | Moren, Jr. | 242/125.1 |
| 3,935,939 | A | | 2/1976 | Schmidt et al. | 400/208 |
| 3,986,680 | A | | 10/1976 | Cardell | 242/125.1 |
| 4,013,237 | A | | 3/1977 | Perrino | 242/476.4 |
| 4,050,645 | A | | 9/1977 | Burchette, Jr. et al. | 242/125.1 |
| 4,050,646 | A | | 9/1977 | Burchette, Jr. | 242/125.1 |
| 4,062,501 | A | | 12/1977 | Eisenberg et al. | 242/474.5 |
| 4,063,696 | A | | 12/1977 | Kelly et al. | 242/125.1 |
| 4,069,984 | A | | 1/1978 | Klink et al. | 242/476.1 G |
| 4,077,197 | A | | 3/1978 | Bowden et al. | 57/403 |
| 4,094,476 | A | | 6/1978 | Schmidt et al. | 242/125.2 |
| 4,106,711 | A | | 8/1978 | Oswald et al. | 242/487.6 |
| 4,138,069 | A | | 2/1979 | Bonzo et al. | 242/474.5 |
| 4,165,055 | A | | 8/1979 | Dee | 242/125.2 |
| 4,184,652 | A | | 1/1980 | Rovin | 242/118.2 |
| 4,184,653 | A | | 1/1980 | Bonzo | 242/125.1 |
| 4,317,548 | A | | 3/1982 | Rottleb | 242/125.2 |
| 4,381,088 | A | | 4/1983 | Bryant | 242/118.7 |
| 4,412,662 | A | | 11/1983 | Rutecki | 242/125.3 |
| 4,477,034 | A | | 10/1984 | Oswald | 242/476.6 |
| 4,482,099 | A | | 11/1984 | Oswald et al. | 242/487.6 |
| 4,569,763 | A | | 2/1986 | Arai | 210/497.1 |
| 4,655,922 | A | | 4/1987 | Arai | 210/497.1 |
| 4,659,032 | A | | 4/1987 | Rottleb | 242/118.4 |
| 4,739,694 | A | | 4/1988 | Flüeli et al. | 91/394 |
| 4,760,976 | A | | 8/1988 | Burchette, Jr. | 242/118.11 |
| 4,817,896 | A | | 4/1989 | Busenhart et al. | 242/476.6 |
| 4,828,200 | A | | 5/1989 | Adams et al. | 242/118.3 |
| 4,834,314 | A | | 5/1989 | Powel et al. | 242/125.1 |
| 4,842,213 | A | | 6/1989 | Bärtschi et al. | 242/125.1 |
| 4,852,823 | A | * | 8/1989 | Adams et al. | 242/125.1 |
| 4,880,183 | A | | 11/1989 | Kubata et al. | 242/125.1 |
| 4,901,941 | A | * | 2/1990 | Powel et al. | 242/125.1 |
| 4,907,758 | A | | 3/1990 | Powel et al. | 242/125.1 |
| 4,919,359 | A | | 4/1990 | Powel et al. | 242/125.1 |
| 4,936,523 | A | | 6/1990 | Powel et al. | 242/125.1 |
| 5,029,762 | A | | 7/1991 | Behrens et al. | 242/473.5 |
| 5,062,580 | A | | 11/1991 | Meagher | 242/125.2 |
| 5,165,623 | A | | 11/1992 | Smith | 242/322 |
| 5,167,994 | A | | 12/1992 | Paulson | 428/34.2 |
| 5,170,961 | A | | 12/1992 | Bolz et al. | 242/586 |
| 5,211,354 | A | | 5/1993 | Rummage | 242/125.1 |
| 5,248,111 | A | | 9/1993 | Teckentrup et al. | 242/125.1 |
| 5,393,582 | A | * | 2/1995 | Wang et al. | 428/34.2 |
| 5,441,780 | A | | 8/1995 | Bushell et al. | 428/34.2 |
| 5,505,395 | A | * | 4/1996 | Qiu et al. | 242/118.32 |
| 5,549,257 | A | | 8/1996 | Sanda et al. | 242/580 |
| 5,702,063 | A | | 12/1997 | Bottari | 242/125.2 |
| 5,791,574 | A | | 8/1998 | Hastings | 242/476.6 |
| 6,073,868 | A | | 6/2000 | Stevens et al. | 242/118.32 |
| 6,193,186 | B1 | | 2/2001 | Kewin | 242/613.5 |
| 6,276,528 | B1 | | 8/2001 | Nowotny et al. | 206/397 |
| 6,412,728 | B1 | | 7/2002 | Jen | 242/476.6 |
| 6,595,456 | B2 | | 7/2003 | Rummage | 242/476.6 |
| 6,851,643 | B2 | * | 2/2005 | Qiu et al. | 242/609.4 |
| 2003/0209628 | A1 | | 11/2003 | Rummage | 242/476.6 |
| 2004/0000607 | A1 | | 1/2004 | Couchey | 242/118.32 |

FOREIGN PATENT DOCUMENTS

| | | | | |
|---|---|---|---|---|
| DE | 39 23 305 | A1 | | 2/1990 |
| DE | 3923305 | A | | 2/1990 |
| EP | 1 375 406 | A | | 1/2004 |
| GB | 1 563 692 | | | 3/1980 |
| JP | 05043140 | A | * | 2/1993 |

* cited by examiner

FIG.1
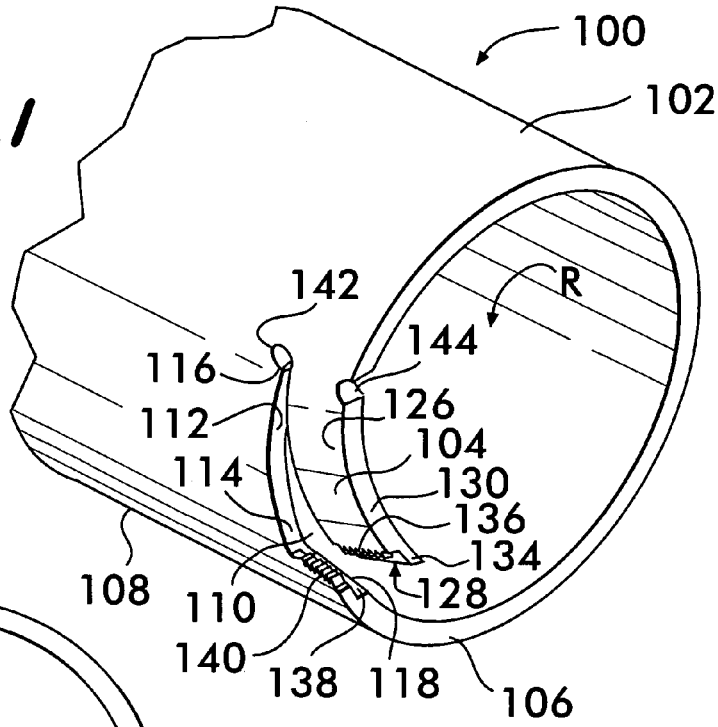
FIG.2
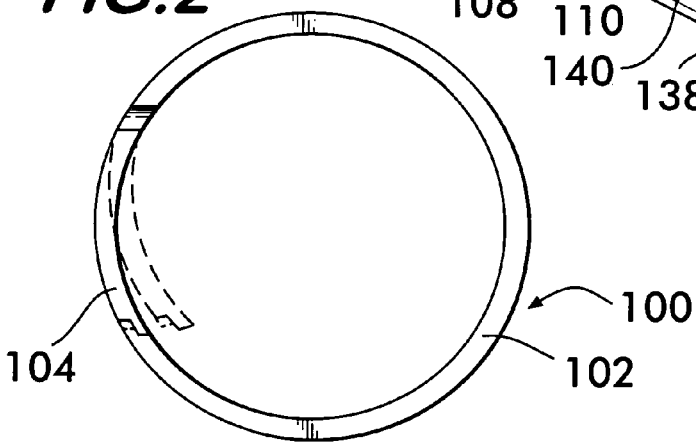
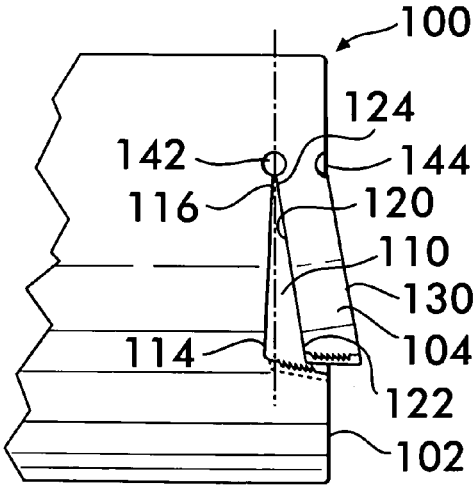
FIG.3A
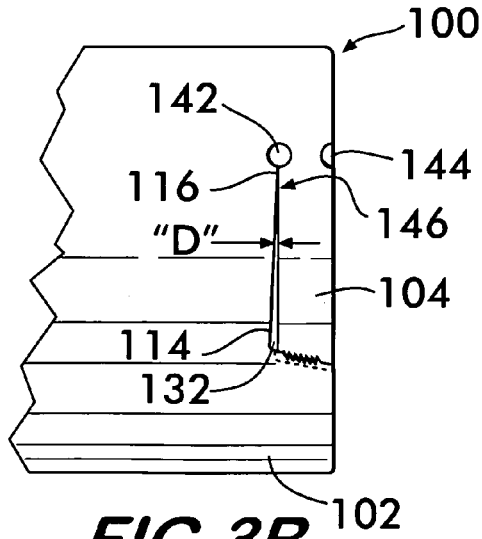
FIG.3B

FIG.15
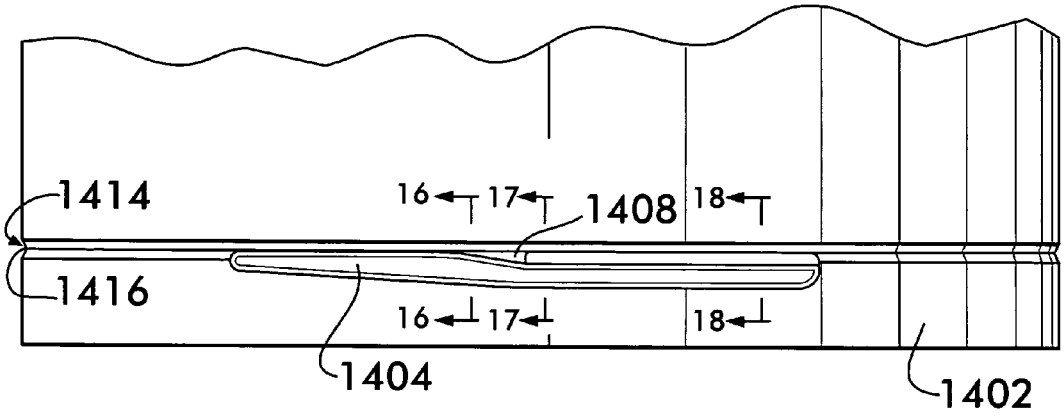
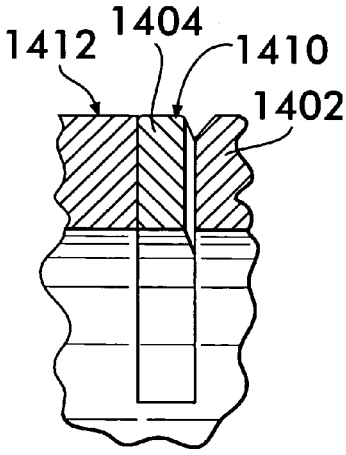
FIG.16
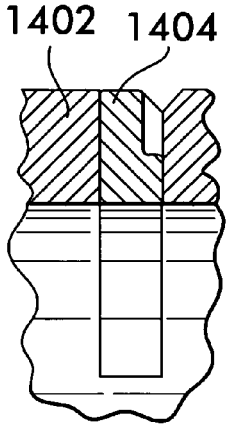
FIG.17
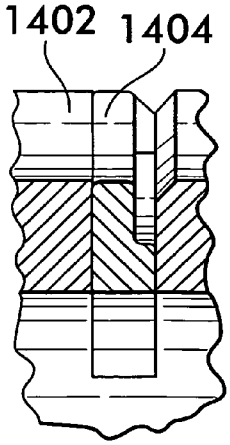
FIG.18

FIG.19A
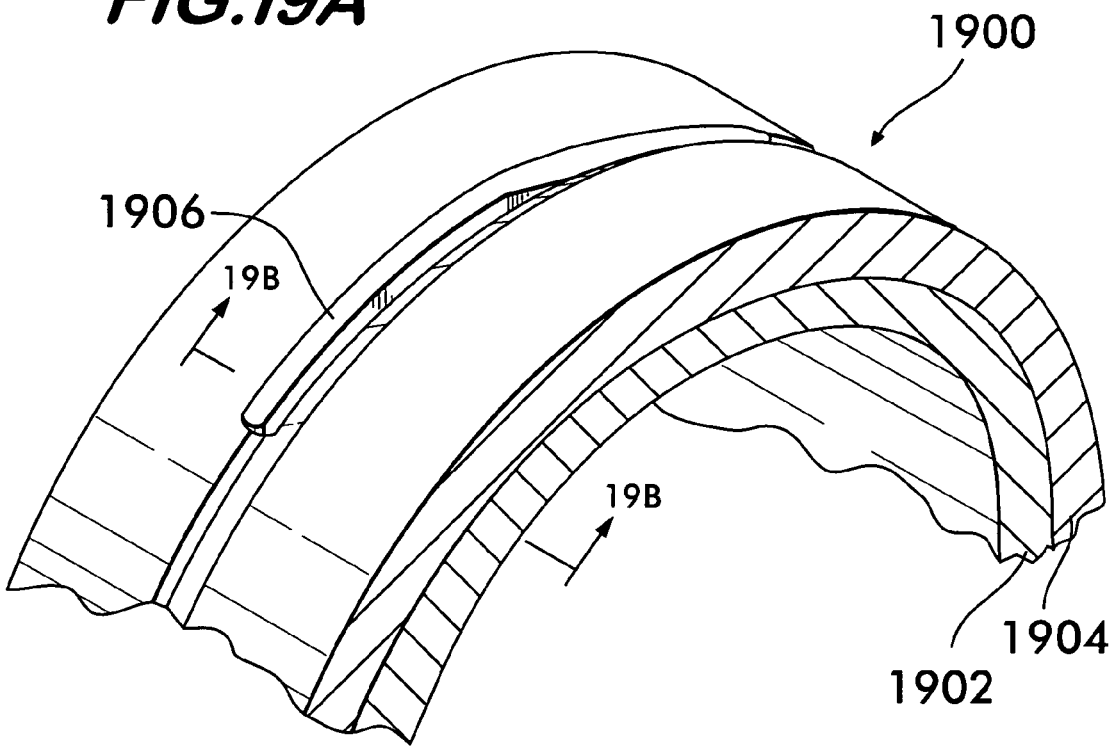
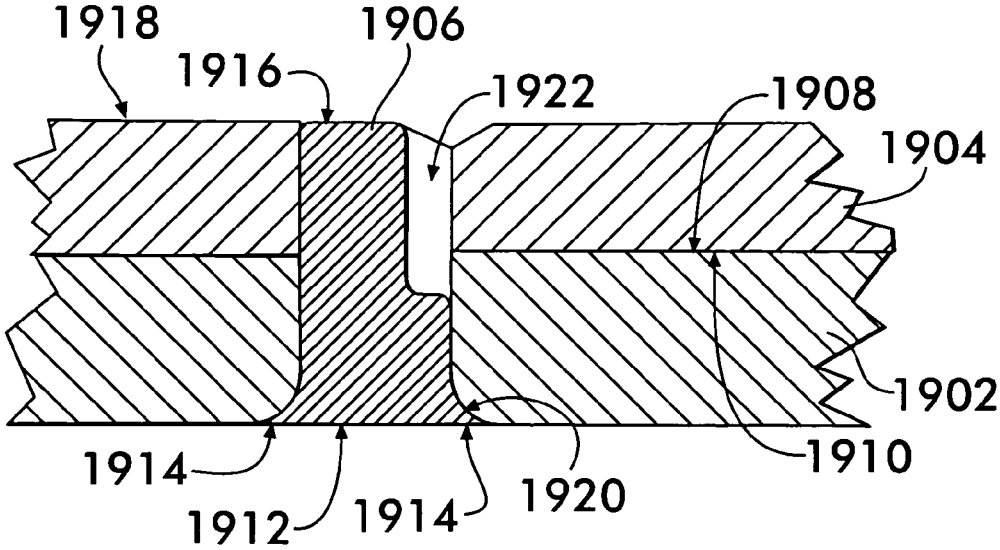
FIG.19B

FIG.27
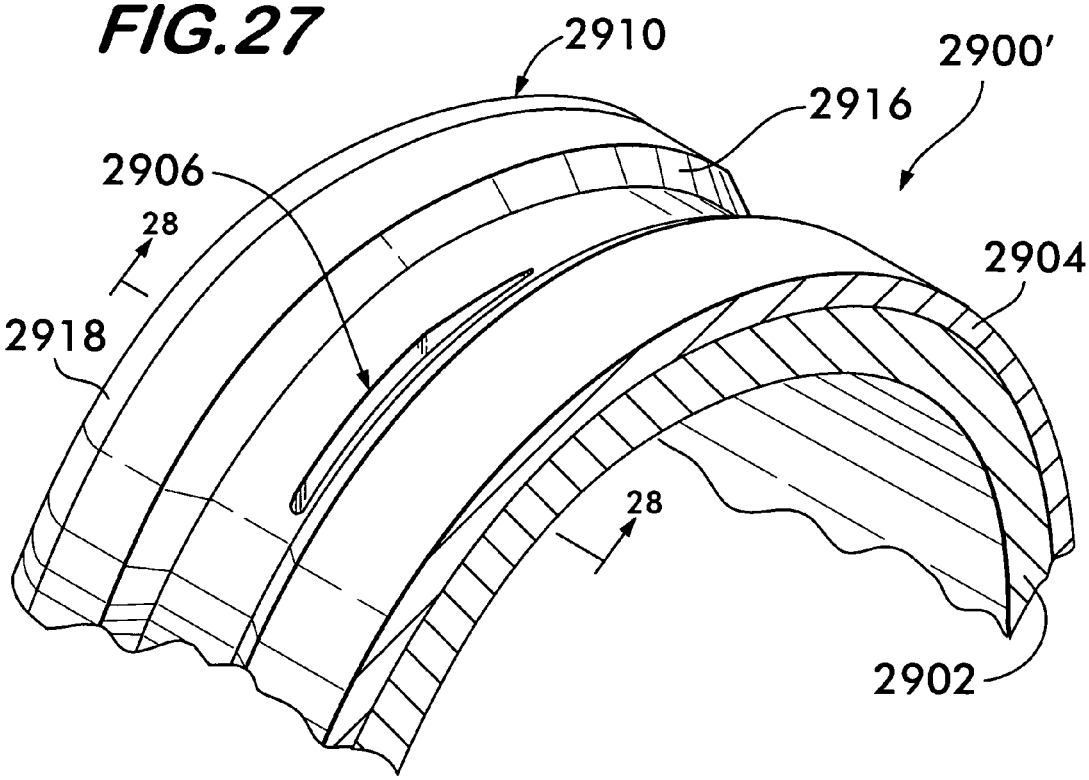
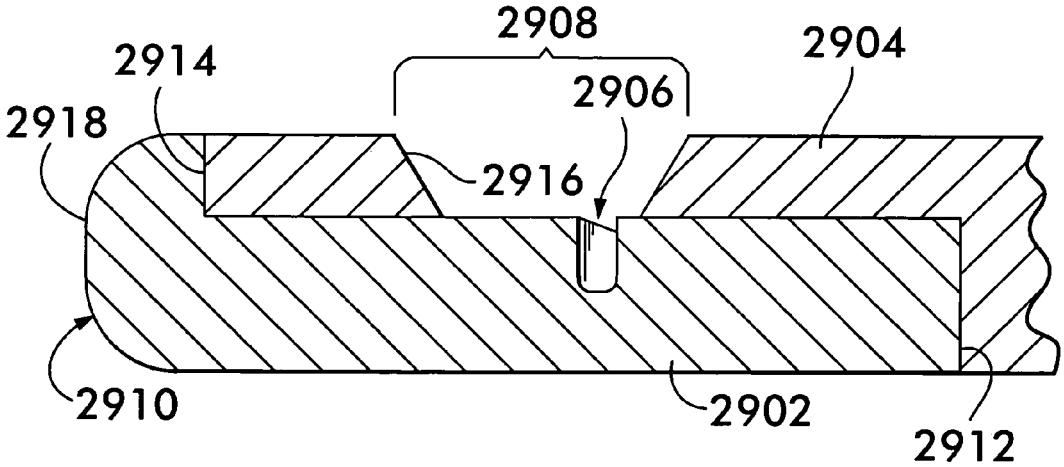
FIG.28

YARN CARRIER

FIELD OF THE INVENTION

The present invention relates to a yarn carrier and, in particular, to a yarn carrier having a cleanable pick-up groove for high speed winding operations.

BACKGROUND OF THE INVENTION

Textile yarn cores, i.e., yarn winding tubes, yarn carriers or bobbins, are employed in the textile industry for winding and supporting yarn packages. In the package forming process, a moving yarn line is strung up onto a rapidly rotating empty core. The moving yarn line is brought into tangential contact with the rotating empty core. Typically, a start-up (or pick-up) groove is provided in the surface of the core, normally adjacent one end of the core. The yarn line is directed into the groove which grips and breaks the yarn line, thereby initiating the wind-up process.

Multiple width start-up grooves in yarn cores have been provided in an effort to improve the yarn pick up propensities of the groove. In the multiple width pick up grooves, one longitudinal, i.e., lengthwise, portion of the groove is relatively wide while an adjacent longitudinal portion is relatively narrow. The core is rotated so that the wide portion of the groove forms the leading portion; the narrow portion of the groove forms the trailing portion. The transition portion of the groove, between the wide and narrow portions, then forms a "nip" for gripping and catching the yarn. The initial strands of the yarn that are caught by the groove during the initial few turns of the automatic winding operation are commonly referred to as the "transfer bunch." When the yarn is removed from the package, the last few strands of the transfer bunch often remain in the groove.

The string-up efficiency, defined as the percentage of successful string-ups over time as compared to the total attempted number of string-ups, is reduced with repeated use of a yarn winding tube. This reduction is partly due to the compression of the fiber fibrils of a paper tube, for example, that assist in the catching of the yarn and which are further damaged when the transfer bunch is removed from the groove. The efficiency reduction is also partly due to the portion of the transfer bunch that remains in the groove and diminishes the ability of the groove to further catch yarn.

A missed string-up, even in one yarn carrier, results in a significant loss of production, since yarn carriers are used in multiple carrier winders (e.g., 2, 4, . . . 10) per shaft. A missed string-up requires human intervention in re-stringing up of the position, sometimes requiring wiping of the spinneret face. When one in a gang of yarn carriers fails to string-up, this process may result in a loss of 10-30 minutes of production time.

It is desirable to reduce manufacturing costs by maintaining a high string-up efficiency and to reduce part costs by re-using yarn carrier tubes. These are often conflicting goals because the string-up efficiency of a tube deteriorates with repeated use of a yarn carrier tube due to damage cause by removal of yarn from the groove and due to yarn remaining in the groove.

It is often difficult to remove all the remaining strands of the transfer bunch from the groove without damaging the tube, especially when the tube is made of paper. This is because typical yarn catching grooves are very difficult to clean due to the very tight grip imparted by the walls of the groove on the yarn. Removal of the yarn usually results in broken filaments being retained in the groove.

One method of removing yarn from the groove, vacuuming, may not damage the tube but typically does not remove all the yarn from the groove. As the carrier is reused, accumulation of broken filaments and wall deterioration increases, further decreasing string-up efficiency. Other methods, such as using a knife to clean the groove, may remove the transfer bunch from the groove but may also damage the surface of the tube or the groove, thereby making the tube unsuitable for further use.

Reuse of the groove is thus limited due to the deterioration of the groove surface and to the collection therein of broken filaments. As a result, yarn carriers are often discarded with little or no reuse rather than incur the increased cost of production that results from a low string-up efficiency.

SUMMARY OF THE INVENTION

According to the present invention, there is provided a yarn carrier for winding yarn thereon. The yarn carrier includes a hollow cylindrical tube having a longitudinal axis extending lengthwise between first and second opposite ends thereof and having a substantially cylindrical outer surface. The tube has a recess formed into the first end. The recess has an inside surface with first and second ends, and a first recess side surface extending from the first end of the inside surface to the first end of the tube. A yarn catch insert is adapted to be inserted into the recess. The yarn catch insert has an inside surface with first and second ends, an outside surface, and a first side surface extending between the first end of the inside surface and its outside surface. When the yarn catch insert is inserted into the recess, the inside surface of the yarn catch insert is positioned opposite the inside surface of the recess and the distance between the inside surface of the recess and the inside surface of the yarn catch insert tapers along at least a portion of the inside surface of the recess.

According to another aspect of the invention, there is provided a yarn catch insert for insertion into a hole formed through a yarn winding tube. The yarn winding tube is a hollow cylindrical tube having a longitudinal axis extending lengthwise between first and second opposite ends thereof and having a substantially cylindrical outer surface. The hole in the tube has a side surface with a portion extending circumferentially around a portion of the circumference of the tube. The yarn catch insert has an inside surface, and outside surface, and a side surface, a portion of the side surface is positioned opposite the portion of the side surface of the hole when the insert is inserted into the hole to form a start-up groove between the portion of the side surface of the yarn catch insert and the portion of the side surface of the hole. At least a portion of the start-up groove is tapered in a direction along the circumference of the tube.

According to another aspect of the invention, there is provided a yarn catch insert having a first member and a second member. The first member has a first end, an opposite second end, and an inner surface. The second member has a first end, an opposite second end, and an inner surface. The first and second members are adapted to be inserted into a hole in a yarn winding tube such that their respective inner surface are positioned opposite each other. The distance between the inner surfaces tapers along at least a portion of the inner surfaces to form a start-up groove.

According to a further aspect of the invention, there is provided a yarn carrier for winding yarn thereon. The yarn carrier includes a hollow cylindrical tube having a longitudinal axis extending lengthwise between first and second opposite ends thereof. The tube has substantially cylindrical inner and outer surfaces and a non-symmetrical hole formed therein for accepting a yarn catch insert.

According to a still further aspect of the invention, there is provided a yarn carrier for winding yarn thereon. The yarn carrier includes a hollow cylindrical inner tube and a hollow cylindrical outer tube. Each tube has a longitudinal axis extending lengthwise between first and second opposite ends thereof, a substantially cylindrical outer surface, and a hole formed through the tube. The inner tube is disposed within the outer tube so that the holes in the inner and outer tubes are substantially aligned for receiving a yarn catch insert.

According to yet another aspect of the invention, there is provided a yarn carrier for winding yarn thereon. The yarn carrier includes a hollow cylindrical tube and a ring. The tube has an external annular channel adjoining one end of the tube, the channel having a base surface radially inward of the outer surface of the tube. A shoulder is formed between the outer surface of the tube and the base surface of the channel. The shoulder extends substantially radially inward from the outer surface of the tube to the base surface of the channel. A recess in the shoulder extends around a portion of the tube circumference and has an inside surface. The ring is adapted to be removably retained within the channel. The ring has a ring engagement surface positioned adjacent the shoulder when the ring is retained within the first channel. The ring engagement surface has a protrusion coinciding with the recess in the shoulder and having a surface cooperating with the inside surface of the recess to form a tapered groove for engaging the yarn during winding startup.

According to yet another aspect of the invention, there is provided a yarn carrier for winding yarn thereon. The yarn carrier includes inner and outer hollow cylindrical tubes and a ring. The inner and outer tubes each have substantially cylindrical inner and outer surfaces, a first end, an opposite second end, and inner and outer surfaces therebetween. The outer diameter of the inner tube is slightly less than the inner diameters of the outer tube and ring so the inner tube may be tightly coupled within the outer tube and ring. A recess is formed in the first end of the outer tube. The ring has a first end surface and a second end surface, the first end surface adjoining the first end of the inner tube, the second end surface having a protrusion coinciding with the recess in the outer tube and having a surface cooperating with the inside surface of the recess to form a tapered groove for engaging the yarn during winding startup.

According to yet another aspect of the invention, there is provided an apparatus for forming a hole in a hollow cylindrical tube. The apparatus includes a die having an opening formed therein for receiving a punch and having an outer surface that substantially matches the curvature of at least a portion of the inner surface of the tube. The outer surface of the die extends radially outward in the vicinity of and as it approaches the opening in the die. When a hole is punched into the tube by placing the die in the tube and then inserting the punch through the tube and into the opening in the die, a countersink is formed on the inner surface of the tube adjacent to the hole formed in the tube.

BRIEF DESCRIPTION OF THE DRAWINGS

FIG. 1 is an isometric view of a yarn carrier according to the present invention;

FIG. 2 is a side elevation view of the yarn carrier shown in FIG. 1;

FIG. 3A is a top view of the yarn carrier shown in FIG. 1 with its yarn catch insert in an open position;

FIG. 3B is a top view of the yarn carrier shown in FIG. 1 with its yarn catch insert in a closed position;

FIG. 15 is a top view of the yarn carrier shown in FIG. 14 having its yarn carrier insert positioned within the yarn carrier tube;

FIGS. 16-18 are cross-sectional views of the yarn carrier of FIG. 15 taken along the lines 16-16, 17-17, and 18-18, respectively;

FIG. 19A is an isometric view of the yarn carrier according to another embodiment of the present invention having a yarn carrier insert positioned within the yarn carrier tube that comprises an inner core and an outer sleeve;

FIG. 19B is a cross-sectional view of the yarn carrier of FIG. 19A taken along the line 19B-19B;

FIG. 27 an isometric view of the yarn carrier according to another embodiment of the present invention having a yarn capturing groove positioned within the inner core of a composite yarn carrier tube;

FIG. 28 is a cross-sectional view of the yarn carrier of FIG. 27 taken along the line 27.

DETAILED DESCRIPTION OF THE INVENTION

Figure 4:
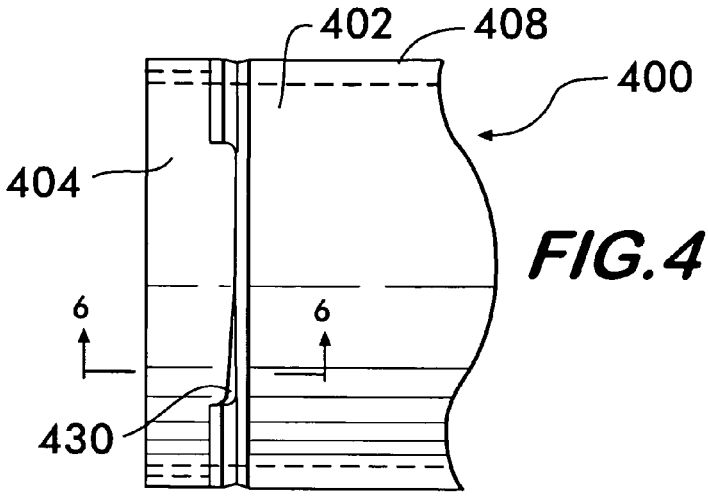
FIG. 4 is a top view of an assembled yarn carrier according to another embodiment of the present invention.

Referring to the drawings, in which like reference numerals illustrate corresponding or similar elements throughout the several views, there is shown in FIG. 1 an isometric view of a yarn carrier 100 for winding yarn thereon according to an exemplary embodiment of present invention.

The yarn carrier 100 includes a hollow cylindrical tube 102 and a yarn catch insert 104. The tube 102 has a first end 106, an opposite second end (not shown), and a longitudinal axis extending lengthwise between the first and second ends. The outer surface 108 of the tube 102 is substantially cylindrical.

A recess 110 is formed into the first end 106 of the tube 102. The recess 110 has an inside surface 112 with a first end 114, a second end 116, and a first recess side surface 118 that extends from the first end 114 of the inside surface 112 to the first end 106 of the tube 102. The yarn catch insert 104 flexibly extends from the tube 102 whereby it may be removably inserted into the recess 110. The yarn catch insert 104 may move between an "open" position as shown in FIGS. 1 and 3A where the yarn catch insert 104 is not within the recess 110 and a "closed" position as shown in FIG. 3B where the yarn catch insert 104 is positioned in the recess 110.

The yarn catch insert 104 has an inside surface 120 with first end 122 and a second end 124, an outside surface 126, and a first side surface 128 extending between the first end 122 of the inside surface 120 and its outside surface 130. When the yarn catch insert 104 is in the closed position, a start-up groove 132 is formed between the inside surface 112 of the recess 110 and the inside surface 120 of the yarn catch insert 104. The yarn carrier 100 may then be used for winding operations.

As shown in FIG. 3B, when the yarn catch insert 104 is inserted into the recess 110 (i.e., the "closed" position), the inside surface 120 of the yarn catch insert 104 is positioned opposite the inside surface 112 of the recess 110 and the distance D between the inside surface 112 of the recess 110 and the inside surface 120 of the yarn catch insert 104 tapers to a pinch point 146. As the tube 102 rotates in the direction of arrow R, yarn that is directed into the groove 132 is gripped by the groove 132 to initiate the wind-up process. In the exemplary embodiment shown in FIGS. 1-3, the inside surface 112 of the recess 110 and the inside surface 120 of the yarn catch insert 104 are substantially perpendicular to the longitudinal axis of the tube 102.

After previously-wound yarn is unwound from the yarn carrier 100, the yarn catch insert 104 may be removed from the recess (i.e., moved into the open position) to open up the start-up groove 132 for removal of any fibers from the start-up groove 132. The ability to open the start-up groove 132 allows any yarn "stuck" in the start-up groove 132 to be removed without damage to the start-up groove 132. After cleaning the start-up groove 132, the yarn catch insert 104 may then be restored to the closed position and the yarn carrier 100 may be reused while maintaining a high string-up efficiency because the ability of the start-up groove 132 to catch yarn is not diminished because any previously-stuck fibers have been removed.

Yarn may be wound at a rate of 5000-6000 meters/minute, for example. The corresponding rate of rotation of the tube, in order to maintain the winding rate, causes the yarn catch insert 104 to exert a centrifugal force that must be opposed to prevent the yarn catch insert 104 from extending radially outward of the outer surface 108 of the tube 102. In the exemplary embodiment shown in FIGS. 1-3, the yarn catch insert 104 is removably securable to the tube 102 using a combination of a shelf 134 and teeth 136.

The shelf 134 is positioned radially inward of and extends under the outer surface 108 of the tube 102 when the yarn catch insert 104 is in the closed position. The tube 102 includes a channel 138 formed in the first recess side surface 118 for receiving the shelf 134 of the yarn catch insert 104 when in the closed position. The lower surface of the channel 138 exerts a centripetal force upon the shelf 138 in a direction toward the center of rotation to prevent the yarn catch insert 104 from extending radially outward of the outer surface 108 of the tube 102.

The teeth 136, 140 on the first side surface 128 of the yarn catch insert 104 and/or on the first side surface 118 of the recess 110 are used to removably secure the yarn catch insert 104 in the recess 110. To close the yarn catch insert 104 from an open position, the teeth 136, 140 may be flexible and the yarn catch insert may be rotated in a direction parallel to the longitudinal axis of the tube 102 to engage the teeth 136, 140. To facilitate rotation of the yarn catch insert 104 from the open to closed position, voids 142, 144 are formed in the yarn carrier at the second end 116 of inside surface 112 of the recess 110 and in the outside surface 130 of the yarn catch insert 104. The voids increase the flexibility of the junction where the insert 104 extends from the tube 102. To open the yarn catch insert 104 from a closed position, the yarn catch insert 104 may be pressed axially inward to disengage the teeth 136, 140 as illustrated by the phantom lines in FIG. 2.

Although the start-up groove 132 illustrated in FIG. 3 is designed for catching yarn when the tube 102 is rotated in direction R, the tube 102 may be bi-directionally operable by having a portion of the start-up groove 132 taper in direction R and a different portion of the start-up groove widen in the same direction R. Also, more than one yarn catch insert 104 and recess 110 combination may be formed on one or both ends of the tube 102. One yarn catch insert and recess may have a start-up groove for winding yarn when rotated in direction R and another yarn catch insert and recess may have a start-up groove for winding yarn when rotated in the opposite direction.

The yarn carrier 100 does necessarily require teeth 136, 140 for securing the yarn catch insert 104 in the recess 110. The yarn catch insert 104 may be secured in the recess 110 by placing the yarn carrier 100 upon a spindle for winding that has an end cap or other form of stop. When the tube 102 is pressed and secured against the stop, the yarn catch insert 104 is moved or forced from the open to closed position by positioning the tube 102 against the stop. Alternatively, the yarn catch insert 104 may be permanently bonded within the recess 102 by sonic welding, for example. The yarn carrier 100 may be made of polypropylene, nylon, or other polymers and may be formed by molding, for example. The yarn catch insert 104 may be molded into a normally-open position and then pressed into its closed position as needed for winding operations.

Permanently bonding the yarn catch insert 104 into the recess 110 diminishes its re-usability because the start-up groove 132 can not be opened for cleaning. However, it still provides improved performance over a yarn carrier with a one-piece molded start-up groove because it is difficult to mold a one-piece start-up groove with sidewalls perpendicular to the longitudinal axis or with a pinch point.

Although the yarn catch insert 104 in FIGS. 1-3 is illustrated as extending from the tube 102, in another exemplary embodiment, the yarn catch insert 104 is separate from the tube 102. The separate yarn catch insert 104 may then have teeth and/or a shelf on both ends for secure attachment to the tube 102.

Figure 5:
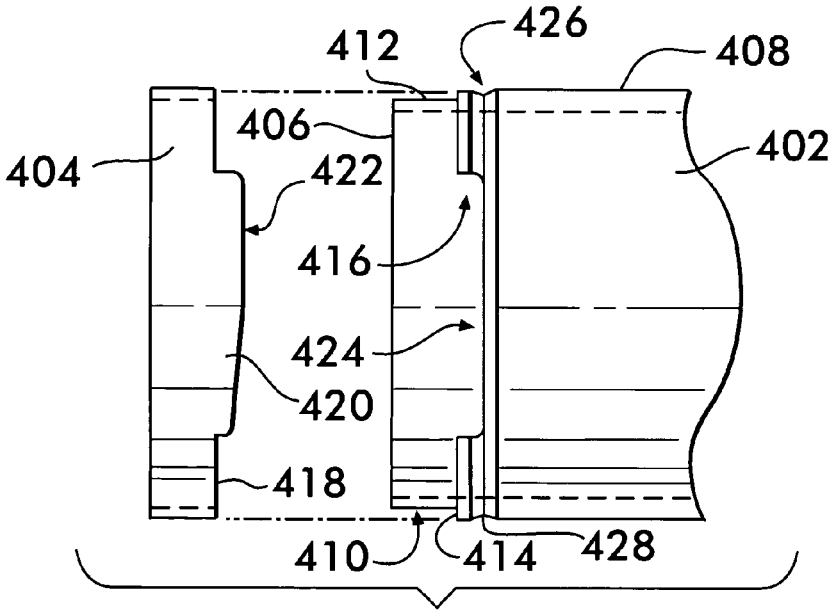
FIG. 5 is an exploded top view of the yarn carrier shown in FIG. 4.
Figure 6:
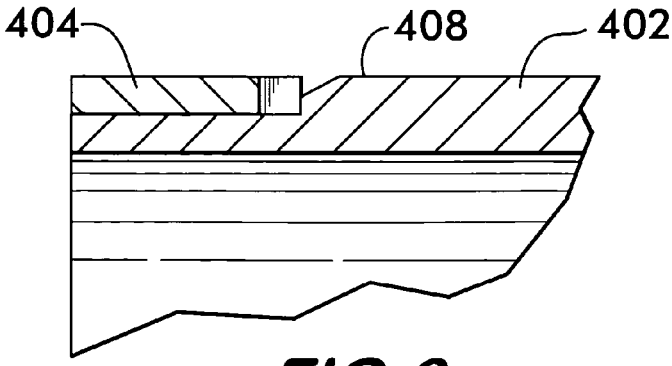
FIG. 6 is a cross-sectional view of the yarn carrier of FIG. 4 taken along the line 6-6.
Figure 7:
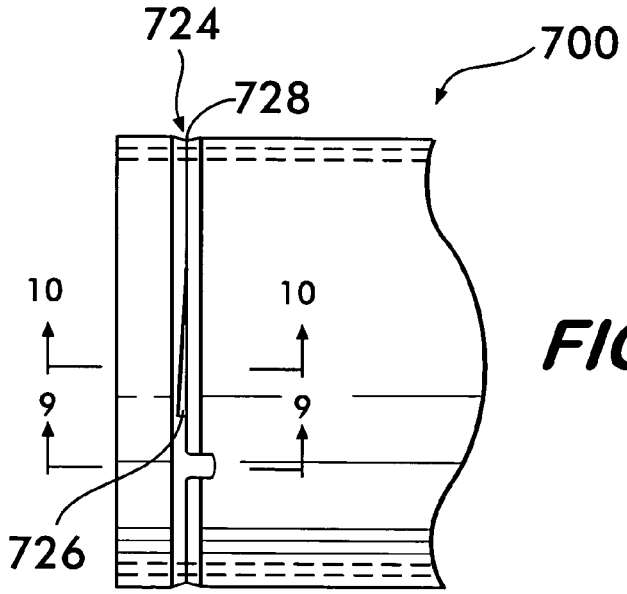
FIG. 7 is a top view of an assembled yarn carrier according to another embodiment of the present invention.
Figure 8:
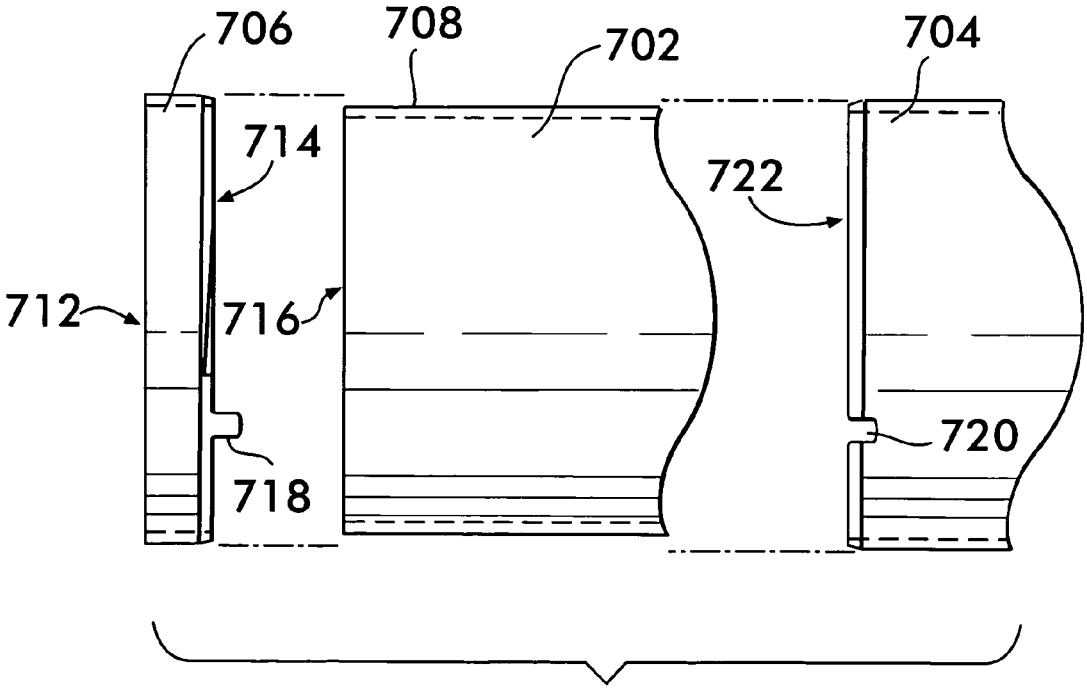
FIG. 8 is an exploded top view of the yarn carrier shown in FIG. 7.
Figure 9:
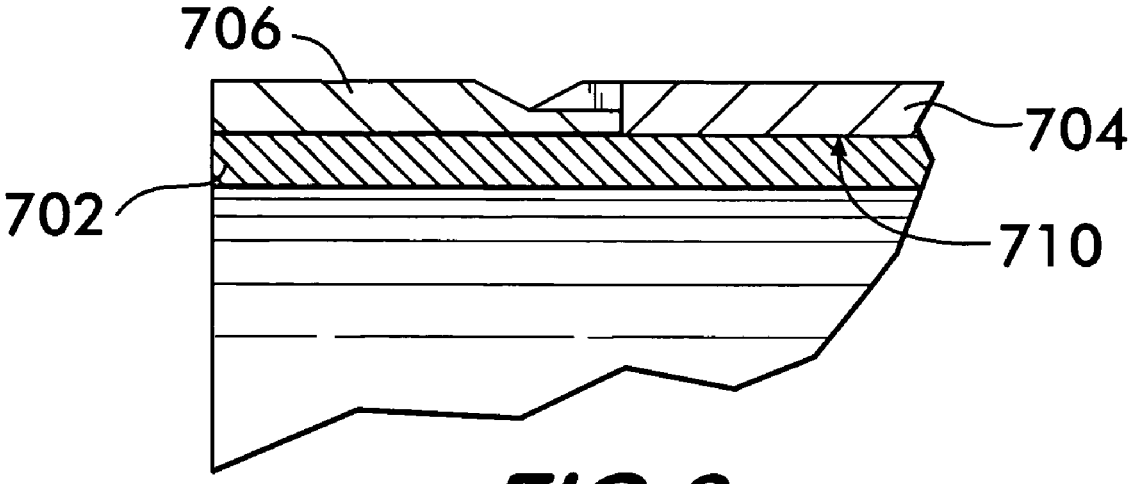
FIG. 9 is a cross-sectional view of the yarn carrier of FIG. 7 taken along the line 9-9.
Figure 10:
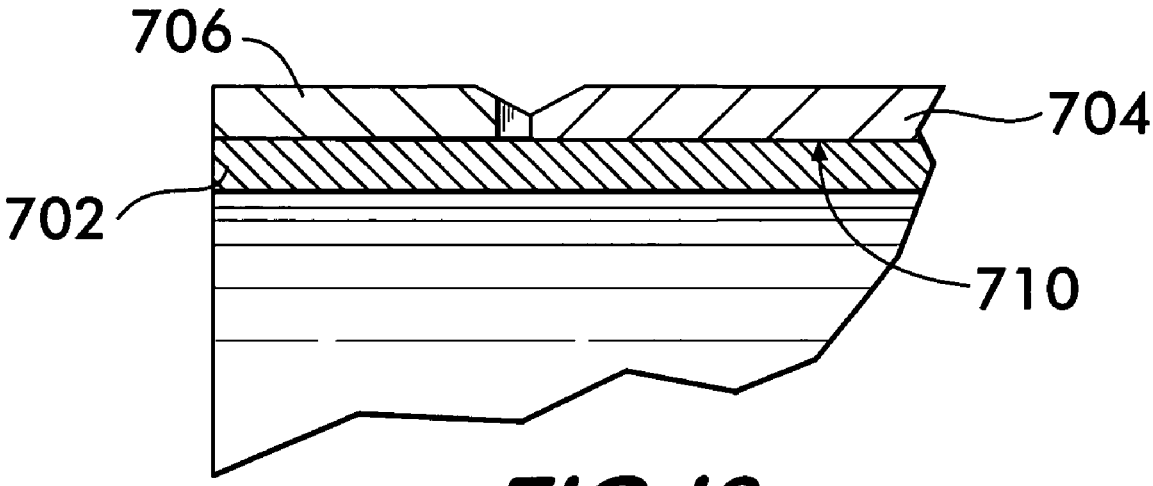
FIG. 10 is a cross-sectional view of the yarn carrier of FIG. 7 taken along the line 10-10.

A yarn carrier 400 according to another embodiment of the present invention is shown in FIGS. 4-6. The yarn carrier 400 includes a hollow cylindrical tube 402 and a resilient ring 404. The ring 404 and the tube 402 are designed to be removably secured to each other, forming a start-up groove 430 between their respective surfaces. After winding and unwinding yarn from the carrier 400, the ring 404 may be removed from the tube 402 to open up the start-up groove 430 and remove of any yarn retained in the groove 430.

The tube 402 has a first end 406, an opposite second end (not shown), and a longitudinal axis extending lengthwise between the first and second ends. The outer surface 408 of the tube is substantially cylindrical. An external annular channel 410 adjoins the first end 406 of the tube 402. The channel 410 has a base surface 412 that is radially inward of the outer surface 408 of the tube 402 with a shoulder 414 formed between the outer surface 408 of the tube 402 and the base surface 412 of the first channel 410. The shoulder 414 extends substantially radially inward from the outer surface 408 of the tube 402 to the base surface 412 of the channel 410. A recess 416 is formed in the shoulder 414, extends around a portion of the tube circumference, and has an inside surface 424.

The resilient ring 404 is adapted to be removably retained within the channel 410. The ring 404 may be retained within the channel 410 by a friction fit, or by other attachment mechanisms such as ribs on the channel surface 412 corresponding to ruts in the inside surface of the ring 404. The ring 404 has a ring engagement surface 418 positioned adjacent to the shoulder 414 when the ring 404 is retained within the channel 410. The ring 404 has a first end surface adjoining the first end of the tube adjacent the first channel.

The ring engagement surface 418 has a protrusion 420 coinciding with the recess 416 in the shoulder 414 of the tube 402. The protrusion 420 has a side surface 422 cooperating with the inside surface 424 of the recess 416 to form a tapered start-up groove for engaging the yarn during winding start-up.

A score 426 is formed in the tube 402 to help direct the yarn into the start-up groove during winding operations. The score 426 may be formed by applying pressure around the circumference of the tube 402 with a rotary tool. The score 426 is formed in the outer surface 408 of and extends around the circumference of the tube 402. The apex 428 of the score 426 intersects the inside surface 424 of the recess 416.

A yarn carrier 700 according to another embodiment of the present invention is shown in FIGS. 7-10. The yarn carrier 700 includes an inner hollow cylindrical tube 702, a outer hollow cylindrical tube 704, and a resilient ring 706. The outer tube 704 and ring 706 are designed to be removably secured adjacent to each other and upon the inner tube 702, forming a start-up groove 726 between their respective surfaces. After winding and unwinding yarn from the carrier 700, the ring 706 and/or outer tube 704 may be removed from the inner tube 702 to open up the start-up groove 726 and remove of any yarn retained in the groove 726.

The outer tube 704 and the ring 706 have inside diameters larger than the outside diameter of the inner tube 702 so the inner tube 702 may be positioned within the outer tube 704 and ring 706. The start-up groove 726 is formed between the end surfaces of the outer tube 704 and ring 706, extending partially around the circumference of the yarn carrier 700. In the embodiment shown in FIG. 7-10, the taper of the start-up groove 726 is formed by the cooperation of a recess formed in the side wall of the ring 706 and the side wall of the tube 704.

The inner tube 702 and outer tube 704 each have a first end, an opposite second end, and a longitudinal axis extending lengthwise between their respective first and second ends. The inner tube 702 has a substantially cylindrical outer surface 708 and an outer diameter measured from the center of the tube to the outside surface 708 of the inner tube 702. The outer tube 704 has a substantially cylindrical inner surface 710, an inner diameter measured from the center of the tube to the inside surface 710 of the outer tube 704, and a recess 720 formed in its first end 722. The inner and outer tubes 702, 704 are manufactured so the inner diameter of the outer tube 704 is slightly greater than the outer diameter of the inner tube 704 so the inner tube may be tightly positioned within the outer tube.

The ring 706 has a first end surface 712 and a second end surface 714. The first end surface 712 adjoins the first end 716 of the inner tube and the second end surface 714 has a protrusion 718 coinciding with the recess 720 in the outer tube. The yarn carrier 700 may be assembled by placing the inner tube 702 within the outer tube 704 and then sliding the ring 706 onto the first end 716 of the inner tube 702 oriented so its protrusion 718 aligns with the recess 720 in the outer tube 704. The protrusion 718 secures the outer tube 704 and the ring 706 so they rotate in unison.

A score 724 is formed in the carrier 700 to help direct the yarn into the start-up groove 726 during winding operations. The score is formed in the outer surface of and extends around the circumference of the carrier 700. The apex 728 of the score 724 coincides with the pinch point of the start-up groove 726. The second end 714 of the ring 706 and the first end 716 of the outer tube 704 are tapered radially inward to together form the score 724.

In an exemplary embodiment, one or more of the inside surface of the outer tube 704, the inside surface of the ring 706, or the outside surface of the inner tube 702 have ribs for securing the ring and outer tube to the inner tube by press fitting, for example. In an exemplary embodiment, the outer tube 704 is made of paper and the inner tube 702 and ring 706 are made of plastic. Although the embodiment shown in FIGS. 7-10 has a recess and protrusion formed in the side wall of the ring 706, one or both of the recess and protrusion could similarly be formed in the ring 704.

Figure 11:
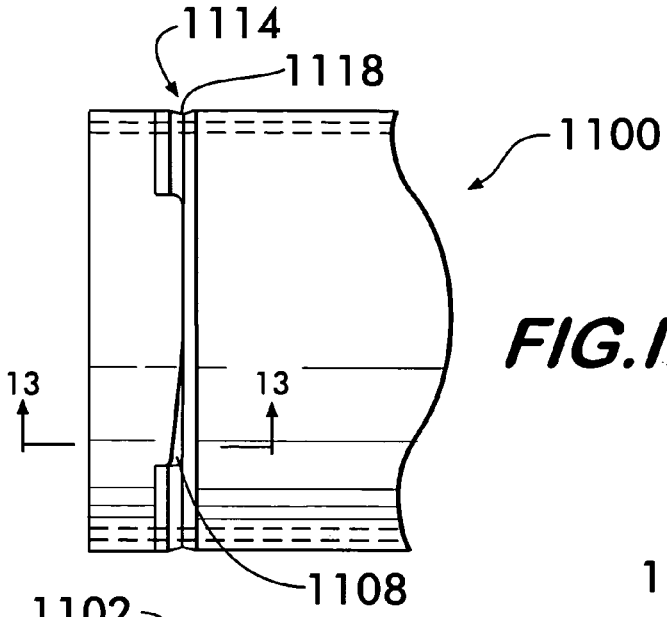
FIG. 11 is a top view of an assembled yarn carrier according to another embodiment of the present invention.
Figure 12:
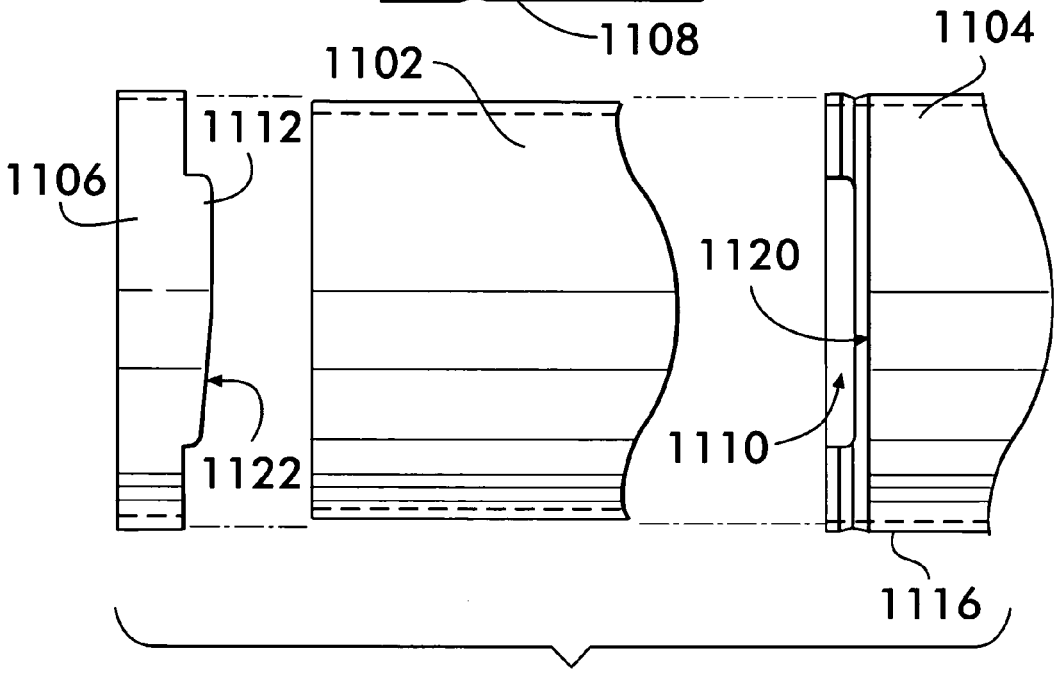
FIG. 12 is an exploded top view of the yarn carrier shown in FIG. 11.
Figure 13:
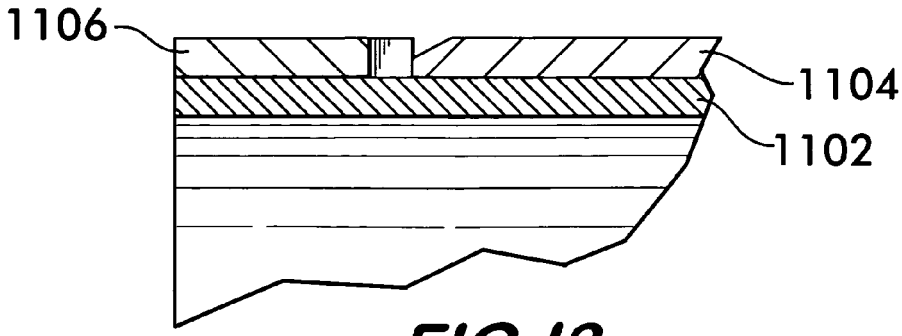
FIG. 13 is a cross-sectional view of the yarn carrier of FIG. 11 taken along the line 13-13.

Another yarn carrier 1100 according to the present invention is shown in FIGS. 11-13. The yarn carrier 1100 includes an inner hollow cylindrical tube 1102, an outer hollow cylindrical tube 1104, and a resilient ring 1106.

The outer tube 1104 and ring 1106 are designed to be removably secured adjacent to each other and upon the inner tube 1102, forming a start-up groove 1108 between their respective surfaces. After winding and unwinding yarn from the carrier 1100, the ring 1106 and/or outer tube 1104 may be removed from the inner tube 1102 to open up the start-up groove 1108 and remove of any yarn retained in the groove 1108.

The outer tube 1104 and the ring 1106 have inside diameters larger than the outside diameter of the inner tube 1102 so the inner tube 1102 may be positioned within the outer tube 1104 and ring 1106. In contrast to the yarn carrier 700 shown in FIGS. 7-10, the start-up groove 1108 of the yarn carrier 1100 is not formed at the intersection of the side surfaces of the outer tube 1104 and the ring 1106. The start-up groove 1108 is formed at the intersection of the side surface 1120 of the recess 1110 of the outer tube 1104 and the side surface 1122 of a protrusion 1112 of the ring 1106. The start-up groove 1108 extends partially around the circumference of the yarn carrier 1100.

A score 1114 is formed in the outer surface 1116 of and extends around the circumference of the outer tube 1104. The apex 1118 of the score 1114 coincides with the pinch point of the start-up groove 1108.

Figure 14:
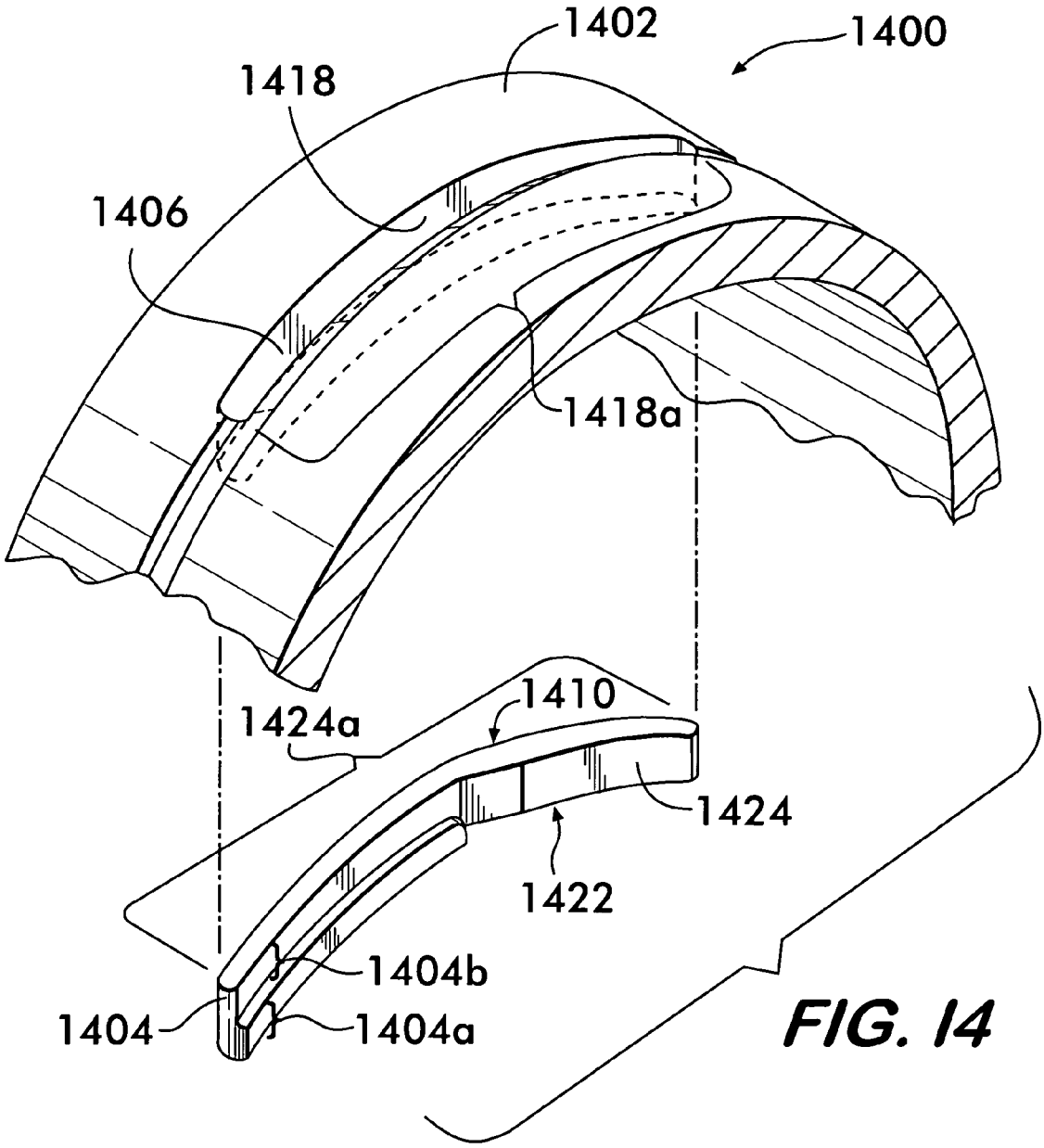
FIG. 14 is an exploded isometric view of a yarn carrier according to another embodiment of the present invention.

A yarn carrier 1400 according to another embodiment of the present invention is shown in FIGS. 14-18. The yarn carrier 1400 includes a substantially cylindrical yarn winding tube 1402 and a yarn catch insert 1404 for insertion through a hole 1406 in the tube 1402. Preferably, the insert 1404 is inserted into the hole 1406 from the inside of the tube as shown in FIG. 14.

The shape of the hole 1406 and the shape of the insert 1404 are designed to form a tapered string-up groove 1408 between a surface of the insert 1404 and a sidewall of the hole 1406. Preferably, the yarn catch insert has a flange (not shown) on its bottom surface to prevent the top surface 1410 of the insert 1404 from extending past the outer surface 1412 of the tube 1402 during winding operations. After winding and unwinding of yarn from the carrier 1400, the insert 1404 may be removed from the tube 1402 by pressing it into the center of the tube 1402. The start-up groove is thereby taken apart and any remaining yarn may be removed. The same or a different insert 1404 may then be re-inserted into the hole 1402 of the same or a different tube 1402 for re-use.

The yarn winding tube 1402 is a hollow cylindrical tube having a longitudinal axis extending lengthwise between first and second opposite ends thereof and having a substantially cylindrical outer surface 1412. The hole 1406 has a side surface 1418 with a first portion 1420 extending circumferentially around a first portion of the circumference of the tube 1402. The yarn catch insert 1404 has a bottom surface 1422, a top surface 1412, and a side surface 1424.

A first portion 1424*a* of the side surface 1424 of the insert 1404 is positioned opposite the first portion 1418*a* of the side surface 1418 of the hole 1406 when the insert 1404 is inserted into the hole 1406 to form the start-up groove 1408 between the first portion 1424*a* of the side surface 1424 of the yarn catch insert 1404 and the portion 1418*a* of the side surface 1418 of the hole 1406. In an exemplary embodiment, the side surfaces 1418*a*, 1424*a* of the insert 1404 and the side surface of the hole 1406 meet or come within a distance of each other that is less than the thickness of the yarn to be wound to form a pinch point to grab the yarn. As shown in FIGS. 16-18, the first portion 1418*a* of the side surface 1418 of the hole 1406 and the first portion 1424*a* of the side surface 1424 of the yarn catch insert 1404 are perpendicular to the longitudinal axis of the tube.

The yarn catch insert 1404 is curved to match the curvature of the tube 1402 and has a lower portion 1404*a* and an upper portion 1404*b*. The lower portion 1404*a* has a width corresponding to the width of the hole in the tube for a tight fit to secure the insert 1404 in the hole 1406. The upper portion 1404*b* has a width less than the width of the hole 1406 in the tube 1402. The start-up groove 1408 is formed in the space between the upper portion 1404*b* of the insert 1404 and the side wall 1418*a* of the hole 1406. The yarn catch insert 1404 may be comprised of materials including plastic, wood, and metal.

As illustrated in FIGS. 15-18, the edges at the top surface 1412 of the insert 1404 are radiused. The radiused edges adjacent to the side walls 1418 of the hole 1406 facilitate insertion of the insert 1404 into the hole 1406. The radiused edges adjacent to the start-up groove 1408 facilitate directing yarn into the start-up groove 1408.

A score 1414 is formed in the outer surface 1412 of and extends around the circumference of the tube 1402. The apex 1416 of the score coincides with the pinch point of the start-up groove 1408.

A yarn catch insert according to the present invention may be used with yarn carriers that include multiple layers of concentric winding tubes. An exemplary yarn carrier 1900 having multiple layers of winding tubes is shown in FIGS. 19A-B. The yarn carrier 1900 includes an inner tube or core 1902, an outer tube or sleeve 1904, and a yarn catch insert 1906. The outer tube 1904, made of paper, for example, is placed on the inner tube 1902, made of plastic or metal, for example, to form a composite yarn carrier into which is inserted an insert 1906 in which a yarn catching mechanism has been molded and/or machined. This composite design allows for the independent replacement of outer and inner tubes as each wears with repeated use.

The inner tube 1902 and outer tube 1904 each have a first end, an opposite second end, and a longitudinal axis extending lengthwise between their respective first and second ends. The inner tube 1902 has a substantially cylindrical outer surface 1908 and an outer diameter measured from the center of the tube to the outside surface 1908 of the inner tube 1902. The outer tube 1904 has a substantially cylindrical inner surface 1910 and an inner diameter measured from the center of the tube to the inside surface 1910 of the outer tube 1904. Similar to the yarn carrier described above with reference to FIGS. 14-18, a portion of the side surface of the insert 1906 and a portion of the side surface of the hole cooperate to form a start-up groove 1922 for gripping yarn during start-up of a winding operation and the insert 1906 may be removed to clean the groove 1922. The yarn catch insert 1906 has a bottom surface 1912 comprising a flange 1914 for preventing the top surface 1916 of the yarn catch insert 1906 from extending radially beyond the top surface 1918 of the outer tube 1904 during winding operations.

The inner and outer tubes 1902, 1904 are manufactured in a manner to tightly positioned them against each other. This may be accomplished by a combination of precise selection of diameters, a selection of materials, and/or use of mechanical connection via ribs or an adhesive, for example. The diameters may be selected so the inner diameter of the outer tube 1904 is just slightly greater than the outer diameter of the inner tube 1904 to achieve a tight fit. Ribs on one or both of the tubes may provide a tight fit between the tubes. In an exemplary embodiment, the inner tube 1902 includes ribs on its outer surface 1908 and the composition of the outer tube is soft enough to absorb the ribs yet sufficiently stiff to provide a tight fit between the tubes 1902, 1904. The composition of the outer tube 1904 may vary along its thickness to provide for a soft inner portion to allow the ribs to bite into the inner tube 1902 and have a stiffer outer portion to resist outer dimensional changes when wound with yarn.

The varying composition provides an added benefit of protecting the inner tube 1902 from deformation. When yarn is wound on the carrier 1900, the radially inward pressure applied against the outer tube 1904 by the wound yarn might otherwise be transferred from the outer tube 1904 to the inner tube 1902 and thereby deform the inner tube 1902. This pressure may be caused by the shrinkage of yarn after the POY process due to thermal and/or molecular shrinkage from polymer crystallization.

If deformed, this would reduce the useful life of the inner tube 1902. This pressure may permanently damage the inner tube 1902 so that it may not be reused and/or shrink its inside diameter so, after winding, it sticks to the spindle. However, with an outer tube 1904 having a variable composition (soft inside, stiff outside), as the outer tube 1904 deforms, its softer inner composition will deform (i.e., crush) to a certain extent to reduce the transfer of force from the outer tube 1904 to the inner tube 1902. In other words, the ribs and soft inner portion of the outer tube 1904 allow a reduction of the outer diameter of the yarn carrier 1900 while not deforming the inner tube 1902 or reducing its inside diameter. This also provides an added benefit for the yarn that has been would no the carrier 1900. As the force applied by the winding is relieved by deformation of the outer paper tube 1904, the yarn is relaxed and less stressed.

As shown in FIG. 19B, holes in each of the inner and outer tubes 1902, 1904 are aligned for accepting the yarn catch insert 1906. The bottom of the hole in the inner tube 1902 includes a countersink 1920 for accepting the flange 1914 of the yarn catch insert 1906. The insert 1906 extends through the hole in both the inner and outer tubes 1902, 1904, thereby locking them together so they rotate in unison. Yarn may be would at a rate of 5000-6000 meters/minute—providing only a fraction of a second to grab the yarn and attach it to the start-up groove. If, at that moment when the yarn is grabbed, the inner tube 1902 moves separately from the outer tube 1904 (e.g., outside keeps turning with yarn while inside turns the opposite way), the catch of yarn may be prevented. Further, any resulting slack in the yarn resulting from the separate movement may cause the yarn to slip or jerk when the yarn does get caught and can break the yarn or filament or may result in non-uniform yarn denier.

A yarn carrier 2000 according to another exemplary embodiment of the present invention is shown in FIGS. 20-23. The yarn carrier 2000 includes a yarn winding tube 2002 and a yarn catch insert 2004. The yarn winding tube 2002 is a hollow and substantially cylindrical tube having a longitudinal axis extending lengthwise between first and second opposite ends thereof. The tube 2002 has a substantially cylindrical outer surface 2006 and has a hole 2008 extending through its outer surface to its center.

Figure 20:
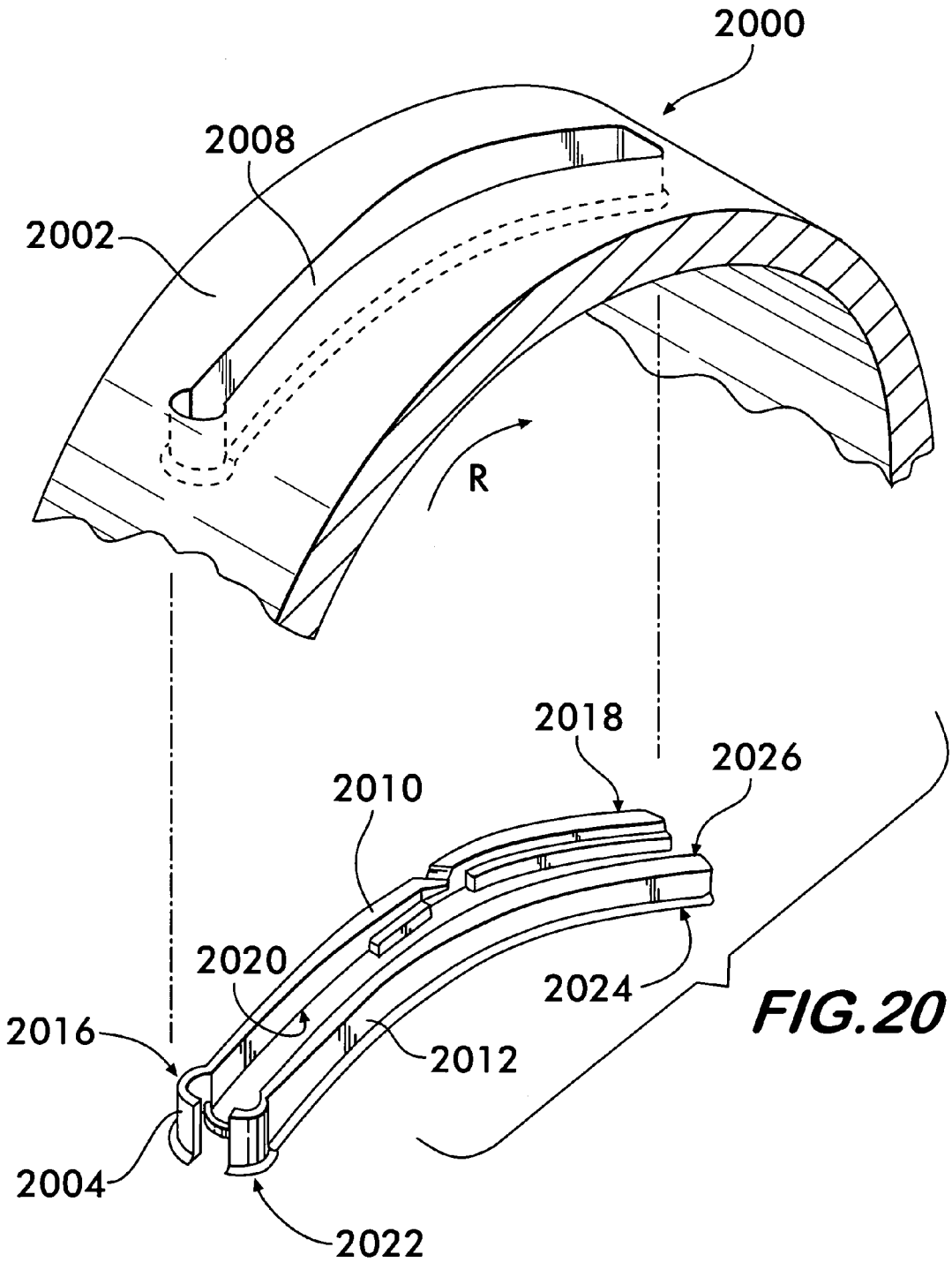
FIG. 20 is an exploded isometric view of a yarn carrier according to another embodiment of the present invention.
Figure 21:
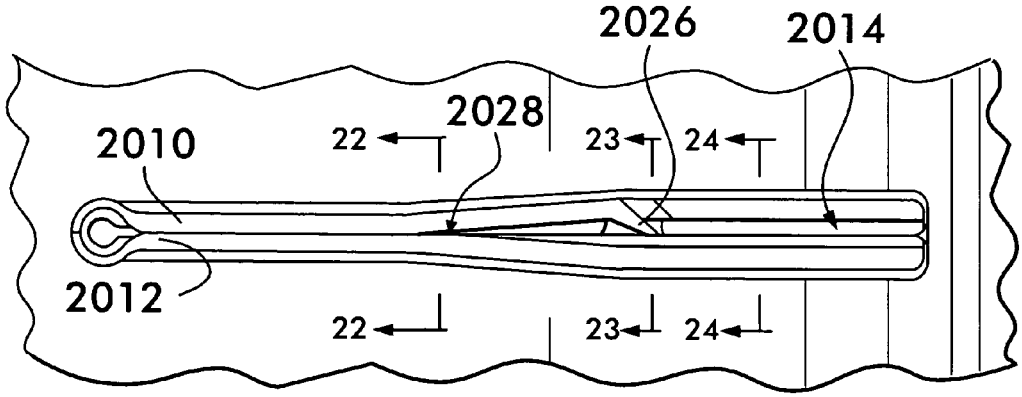
FIG. 21 is a top view of a portion of the yarn carrier shown in FIG. 20 having its yarn carrier insert positioned within the yarn carrier tube.

As shown in FIG. 20, the hole in the tube is asymmetrical which ensures proper orientation of the insert 2004 with respect to the direction of rotation of a winding operation. The shape of the hole in the tube in FIG. 20 resembles a baseball bat with a bulbous head on one end leading to a longitudinal section that widens as it extends from the bulbous head. The direction of rotation of the tube 2002 for winding is indicated by arrow R in FIG. 20. The insert 2004 includes a first member 2010 and a second member 2012 that form a start-up groove 2014 therebetween when inserted into the hole 2008. The insert 2004 may be removed and the first and second members 2010, 2012 separated to clean any yarn from inside the start-up groove 2014.

The yarn catch insert 2004 is adapted to be inserted into the hole 2008 from the inside of and through the yarn winding tube 2002. The insert 2004 includes a first member 2010 and a second member 2012 that may be coupled together by a tether, for example. The first member 2010 has a first end 2016, a second end 2018 opposite the first end, and an inner surface 2020. The second member 2012 has a first end 2022, a second end 2024, and an inner surface 2026 facing the inner surface 2020 of the first member 2010 when the first and second members 2010, 2012 are positioned in the hole 2008.

The start-up groove 2014 is formed between the inner surfaces 2020, 2026 of the first and second members 2010, 2012 of the insert 2004. To form the yarn carrier 2000, the first and second members 2010, 2012 are placed adjacent to each other so their respective inner surfaces 2020, 2026 face each other and the insert 2004 is then inserted into the hole 2008 in the winding tube 2002. As illustrated by the cross-sectional view of FIGS. 22-24, the start-up groove 2014 is tapered to a pinch point 2028. The start-up groove 2014 includes a barb 2026 extending from the inner surface 2020 of the first member 2010 into the start-up groove 2014 and toward the inner surface 2026 of the second member 2012. In an exemplary embodiment, the barb 2026 extends greater than half the distance between the inside surfaces 2020, 2026 of the first and second members 2010, 2012. In another embodiment (not shown), a hook may instead extend from the first surface 2020 of the first member 2010 into the start-up groove 2014.

Figure 22:
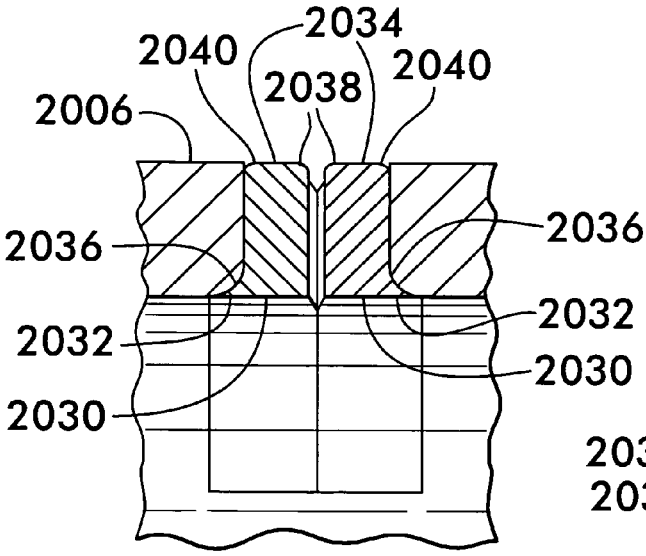
FIGS. 22-24 are cross-sectional views of the yarn carrier of FIG. 21 taken along the lines 22-22, 23-23, and 24-24, respectively.
Figure 23:
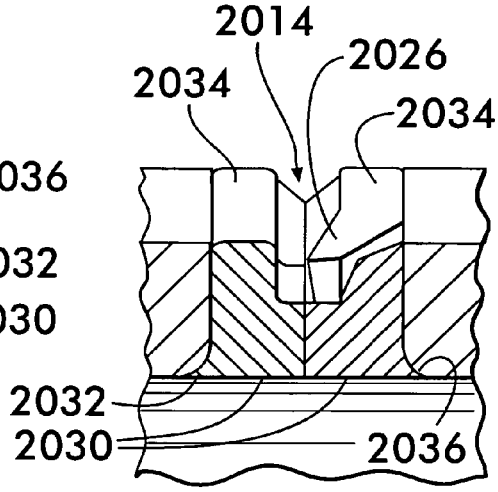
Figure 24:
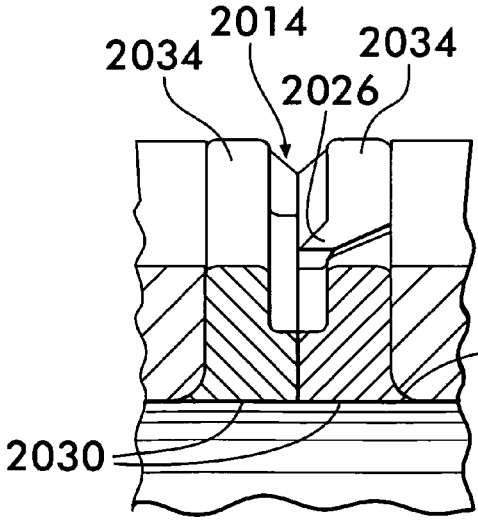

The yarn catch insert 2004 has a bottom surface 2030 comprising a flange 2032 for preventing the top surface 2034 of the yarn catch insert 2004 from extending radially beyond the top surface 2006 of the tube 2002 during winding operations when the tube 2002 is spinning. As shown in FIGS. 22-24, the bottom of the hole 2008 in the inner tube includes a countersink 2036 for accepting the flange 2032 of the yarn catch insert 2004. Alternatively, the side walls of the hole 2008 may be tapered in a direction from the inside to the outside of the tube 2002 and the outside walls of the yarn catch insert 2004 may be similarly tapered to prevent the yarn catch insert 2004 from extending radially beyond the top surface 2006 of the tube 2002 during winding operations.

The inner surfaces 2020, 2026 of the first and second members 2010, 2012 are perpendicular to the longitudinal axis of the tube 2002 when they are disposed in the hole 2008. In an exemplary embodiment, an adhesive is applied to the outer surface 2034 of at least one of the first and second members 2010, 2012 to facilitate the process of grabbing the yarn during a string-up procedure. Although the insert 2004 is shown in FIGS. 20-23 as being inserted into a hole 2008 formed through a single tube 2002, the insert may be inserted through two or more tubes in a similar fashion to that shown in FIGS. 19A-B for securing multiple tubes together. With multiple tubes, the insert acts as a key as described above with reference to FIGS. 19A-B to mechanically link the tubes together.

As shown in FIGS. 22-24, the edges 2038, 2040 at the top surface 2034 of the insert 2004 are radiused. The radiused edges 2040 adjacent to the side wall of the hole 2008 facilitate insertion of the insert 2004 into the hole 2008. The radiused edges 2038 adjacent to the start-up groove 1408 facilitate directing yarn into the start-up groove 1408.

Figure 25:
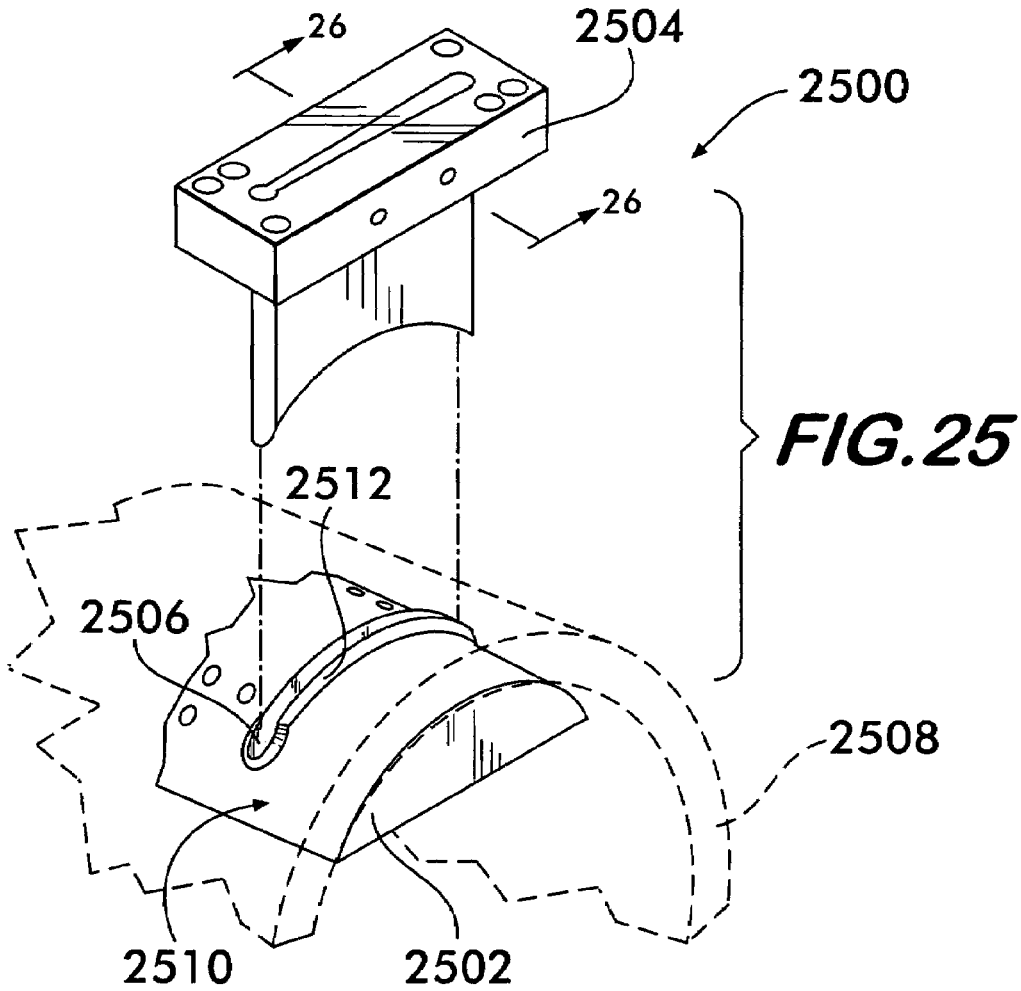
FIG. 25 is an exploded isometric view of an apparatus according to the present invention for forming a hole in a yarn winding tube.
Figure 26:
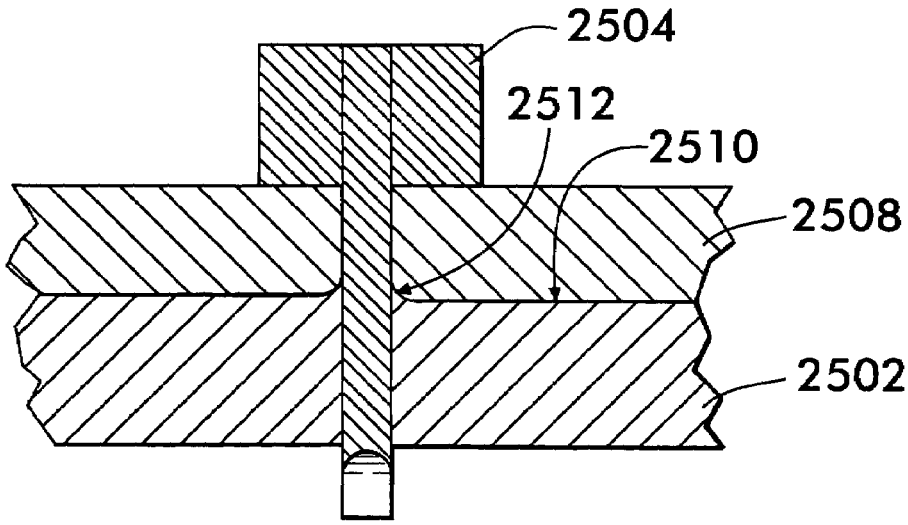
FIG. 26 is a cross-sectional view of the apparatus of FIG. 25 taken along the line 26-26 with the punch positioned in the die after punching a hole through a tube.

An apparatus 2500 for forming a hole in a winding tube 2508 (shown in phantom) is shown in FIGS. 25-26. The hole to be formed is adapted to receive a yarn catch insert. The apparatus 2500 includes a die 2502 and a punch 2504. The die 2502 has an opening 2506 formed therein for receiving a punch 2504. The hole in the tube 2508 is formed by placing the die 2502 within the tube 2508 and pressing the punch 2504, in alignment with the hole 2506 in the die 2502, through the tube 2508. The die 2502 has an outer surface 2510 that substantially matches the curvature of at least a portion of the inner surface of the winding tube 2508.

The outer surface of the die 2510 extends radially upward in the vicinity of the opening to form a lip 2512 as it approaches the opening 2506. When the punch 2504 is pressed into a tube 2508 which is made of a compressible material, such as paper, while the die 2502 is in place inside the tube 2508, the force exerted by the punch 2504 causes the tube 1508 to compress adjacent to the lip 2512 of the die 2502. This compression forces forms a countersink into which the flange of a yarn catch insert is positioned as illustrated in FIG. 22.

Alternatively, when punching a hole through a paper tube that is to function as the outer tube of a multi-tube yarn carrier, the top surface of the die may match the curvature of the inside of the tube and not have a lip in order to form a hole with sidewalls perpendicular to the longitudinal axis of the tube. The inner tube in such a configuration may include a countersink or other tapered shape for preventing the yarn catch insert from extending beyond the outer surface of the outer tube. In the case of the inner tube being a plastic tube, such a feature may be molded, for example, into the inner tube.

A further variation of a yarn winding tube as contemplated by the present invention is shown in FIGS. 27 and 28, wherein the yarn catch groove is provided in the inner layer of a multi-layer winding tube. As illustrated, the yarn carrier 2900 includes an inner tube or core 2902, an outer tube or sleeve 2904, and a yarn catch groove 2906. The outer tube 2904, preferably made of plastic or metal in this embodiment, is placed on the inner tube 2902, preferably made of paper in this embodiment, to form a composite yarn carrier. As illustrated, the yarn catch groove 2906 is formed in the outer surface of the inner tube 2902, which is inserted within the end of the outer tube 2904. The outer tube 2904 has an opening 2908 formed therein so as to expose the yarn catch groove 2906 (or other yarn catching mechanism, such as a separate molded insert). This composite design allows for the use of a paper tube for forming the yarn catch insert with the durability of a plastic outer sleeve.

The replacement of inner tube structure is further facilitated by its shortened structure which forms an insert for the end of the outer tube 2904. The insert 2910 is inserted into the end of the outer tube 2904 and abuts against a shoulder 2912 formed in the inside surface of the outer tube 2904. A rounded end 2918 is provided on the end of the insert 2910, opposite the inserted end that abuts with the shoulder 2912. As illustrated, the rounded end 2918 has a thickness that is greater than the wall thickness of the insert that forms the inner tubular portion 2902. An inside surface of the rounded end 2918 forms a shoulder that abuts against the end 2914 of the outer tube 2904.

The window 2908 is formed in the surface of the outer tube 2904 to provide access to the startup groove 2906. The window 2908 has angled sidewalls to assist in directing the yarn into the grove and to assist in the transition of the yarn onto the winding surface of the outer tube 2904. As shown in FIGS. 27 and 28, the winding startup groove is similar to that shown and described in the yarn carrier of FIGS. 14-18. However, it should be understood that an insert of the type shown and described with respect to FIGS. 19A and 19B or FIGS. 20-24 may be incorporated into the construction. Moreover, the materials of the inner and outer tube may be varied as desired by the user. Again, the inner and outer tubes are preferably manufactured in a manner to tightly positioned them against each other, and may be accomplished by any combination of elements, including those previously described herein.

Figure 29:
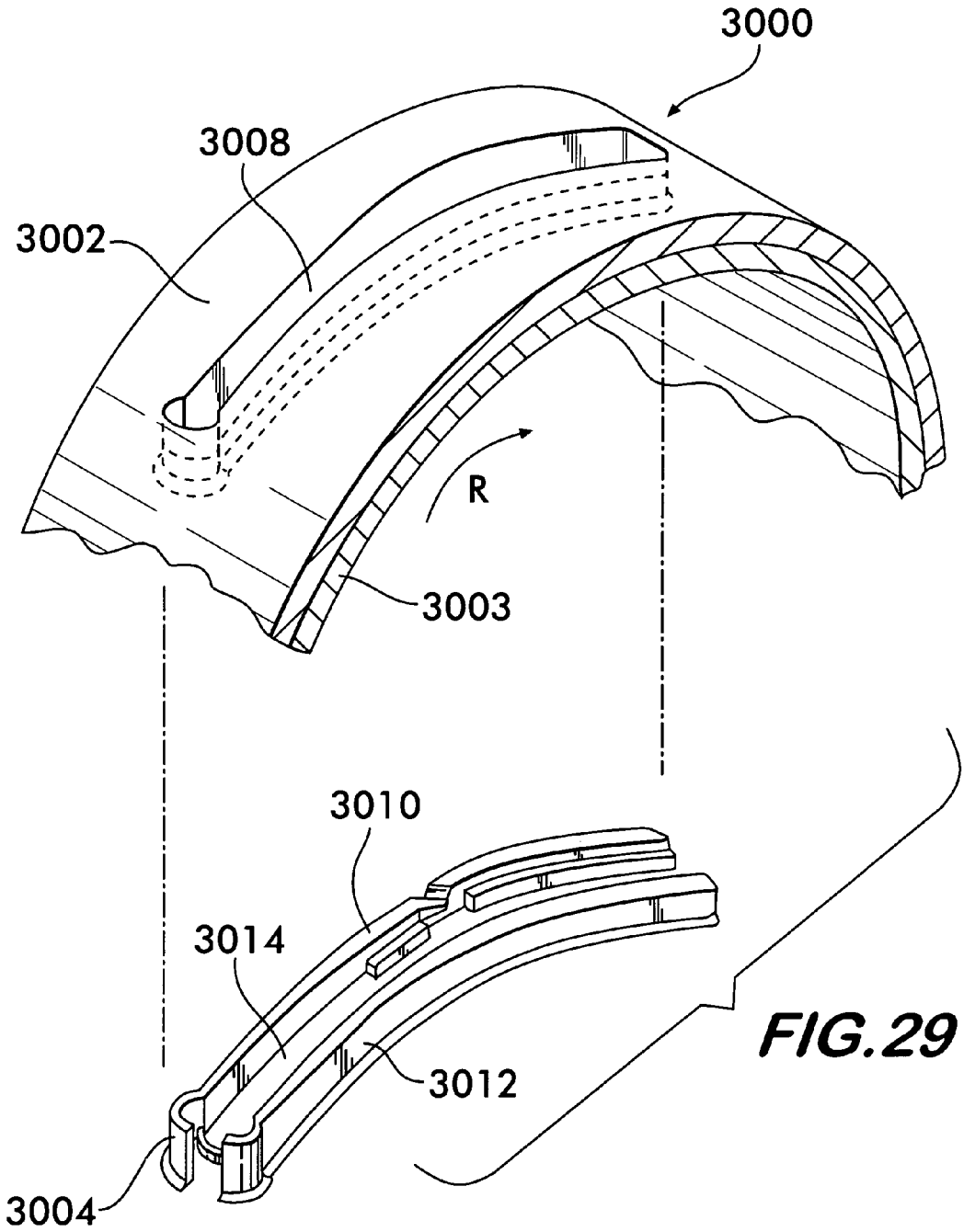
FIG. 29 is an exploded isometric view of a yarn carrier according to another embodiment of the present invention.

A further yarn carrier embodiment is shown in FIG. 29 and is identified generally by the numeral 3000. The yarn carrier 3000 includes an outer yarn winding tube 3002, an inner tube 3003 and a yarn catch insert 3004. In the present embodiment, it is contemplated that the inner tube 3003 is substantially the same length as the outer tube 3002. As illustrated, a hole 3008 is provided in both the outer tube 3002 and inner tube 3003. The hole 3008 is asymmetrical and is formed such the two tubes 3002, 3003 are brought into substantial registration by the insertion of the startup insert 3004. As illustrated, the shape of the hole 3008 in the two tubes and the form of the insert are substantially the same as that shown in FIGS. 20-24. The yarn catch insert 3004 is inserted into the hole 3008 from the inside of the inner tube 3003 and exposed to the outer yarn winding surface of the outer winding tube 3002. The insert 3004 may also be removed from the hole 3008, with the first and second members 3010, 3012 of the insert being separable to clean any yarn residue from inside the groove 3014.

Although embodiments of the present invention is described above with regard to start-up grooves having particular dimensions, the teachings of the present invention are applicable to a variety of types of start-up grooves. For example, inserts may be formed to create start-up grooves for co-current winding or counter-current winding and with our without barbs or hooks. Although some of the embodiments described above have a score and others do not, the particular embodiments are not limited to having or not having a score.

The yarn carriers are shown in the Figures and described above as having a single yarn catch insert. The teachings of present invention may be applied to yarn carriers having multiple yarn catch inserts. A yarn carrier may include one or more yarn catch inserts on one side, on both sides, or elsewhere in the winding tube of a yarn carrier. Further, a single yarn carrier may be formed to create a bi-directional start-up groove to allow winding in either a forward or a backward rotation by having a portion with a taper in one direction and a different portion with a taper in an opposite direction. Also, multiple yarn catch inserts in a single yarn carrier may have different groove directional orientations to allow for bi-directional use of the yarn carrier.

The foregoing describes the invention in terms of embodiments foreseen by the inventors for which an enabling description was available, notwithstanding that insubstantial modifications of the invention, not presently foreseen, may nonetheless represent equivalents thereto.

What is claimed is:

1. In combination, a yarn catch insert and a yarn winding tube, the insert for insertion into a circumferentially elongated hole formed through the yarn winding tube inwardly of the end of the tube, the yarn winding tube comprising:

a hollow cylindrical tube body having a longitudinal axis extending lengthwise between first and second opposite ends thereof and having a substantially cylindrical outer surface, the elongated hole completely surrounded by the cylindrical surface, and the elongated dimension of the hole having a planar side surface with a portion extending in a circumferential direction around a portion of the circumference of the tube body and substantially perpendicular to the longitudinal axis of the tube body, and the yarn catch insert comprising:

an inside surface, an outside surface positioned adjacent the outer cylindrical surface of the tube body when the insert is positioned within the hole, and an extended side surface, a portion of the side surface of the insert positioned opposite the portion of the side surface of the hole when the insert is positioned within the hole, the extended side surface of the insert having a planar first portion and a second portion formed at an angle with respect to the first portion, the opposing portions of the side surfaces of the insert and the hole forming a circumferential start-up groove within the cylindrical outer surface of the tube, at least a portion of the start-up groove being tapered in a direction along the circumference of the tube due to the angular relationship between the first portion and second portion of the side surface of the insert.

2. The combination according to claim 1 wherein the yarn catch insert has a flange adjacent its inside surface for preventing the outside surface of the yarn catch insert from extending beyond the outer cylindrical surface of the tube body.

3. The combination according to claim 1 wherein an edge between the outside surface of the yarn catch insert and at least a portion of the side surface of the insert is radiused.

4. A combination according to claim 3 wherein the outside surface of the yarn catch insert is tapered radially inwardly when positioned within the hole within the tube body.

5. The combination according to claim 1 wherein the start-up groove tapers to a pinch point.

6. The combination according to claim 1 wherein the first portion of the side surface of the insert and the corresponding portion of the side surface of the hole are perpendicular to the longitudinal axis of the tube body.

7. The combination according to claim 1 wherein the yarn catch insert is comprised of one of plastic, wood, and metal.

8. The combination according to claim 1, wherein the yarn catch insert further comprises a lower portion and an upper portion, the lower portion having a width corresponding to the width of the hole in the tube body, the upper portion have a width less than the width of the hole in the tube body, wherein the start-up groove is formed between the side surface of the hole and the upper portion of the yarn catch insert.

9. A yarn carrier for winding yarn thereon comprising:

a. a hollow tube having a longitudinal axis extending lengthwise between first and second ends thereof, the tube having an outer cylindrical surface and an elongated hole through and completely surrounded by the cylindrical surface, the hole positioned inwardly of one end of the tube, the longitudinal dimension of the hole extending in the circumferential direction of the tube; and b. a yarn catch insert positioned within the hole formed through the tube, the hole having an extended planar side surface perpendicular to the longitudinal axis of the tube, the yarn catch insert having an inside surface, an outside surface, and an extended side surface, the extended side surface having a planar first portion and a planar second portion, the planar second portion angled relative to the first portion, the extended side surface of the insert positioned opposite the extended planar side surface of the hole with the first portion parallel to the extended planar side surface of the hole when the insert is positioned within the hole, and the extended side surface of the hole and the extended side surface of the insert forming a start-up groove extending in a circumferential direction around the tube, at least a portion of the start-up groove being tapered.

10. A yarn carrier for winding yarn thereon comprising:

a hollow cylindrical tube having a longitudinal axis extending lengthwise between first and second opposite ends and having substantially cylindrical inner and outer surfaces, the tube having an elongated hole extending between the inner and outer surfaces of the tube and spaced inwardly from one end of the tube, such that the hole is surrounded by at least the outer cylindrical surface of the tube, the hole having a planar side surface with an elongated dimension extending in the circumferential direction of the tube, and an elongated yarn catch insert removably secured within the hole in the tube, the insert having an extended side surface, including a first portion and a second portion, the first portion angled with respect to the second portion, the extended side surface of the insert positioned in an opposing relationship with the side surface of the hole, with the first portion spaced from and substantially parallel to the side surface of the hole and the second portion forming a tapered groove with the side surface of the tube, the insert and the side surface of the hole combining to form a yarn catching start-up groove in the yarn carrier.

11. The yarn carrier according to claim 10 wherein the hole comprises a countersink formed adjacent the inner surface of the tube.

12. The yarn carrier according to claim 10 wherein the hole has a width that tapers in a direction from the inside surface to the outside surface of the tube.

13. A yarn carrier for winding yarn thereon comprising:

a. a hollow cylindrical inner tube having a longitudinal axis extending lengthwise between first and second opposite ends thereof, the inner tube having a substantially cylindrical outer surface and a longitudinally extending hole formed through the inner tube inwardly of one end thereof and extending around a portion of the circumference of the tube, the hole directed radially from an inner tube diameter through to the outer surface, b. a hollow cylindrical outer tube having a longitudinal axis extending lengthwise between first and second opposite ends thereof and coaxially with the longitudinal axis of the inner tube, the outer tube having a substantially cylindrical inner surface with a diameter that is greater than the diameter of the outer surface of the inner tube, and a circumferentially extending elongated hole formed through the outer tube inwardly of one end thereof, such that the hole is surrounded by the outer surface, and the hole in the outer tube having a substantially planar side surface extending in a circumferential direction of the tube, wherein the inner tube is disposed within the outer tube and wherein the circumferentially extending elongated holes in the inner and outer tubes are substantially aligned, and c. an elongated yarn catch insert removably secured within the holes in the inner and outer tubes, the insert having an extended side surface including a first portion and a second portion, the first portion being angled with respect to the second portion, the extended side surface of the insert positioned in an opposing relationship with the side surface of the hole in the outer tube adjacent the outer surface thereof, with the first portion being spaced from and substantially parallel to the side surface of the hole in the outer tube and the second portion forming a tapered groove with the side surface of the outer tube, the insert and the side surface of the hole in the outer tube combining to form a yarn catching start-up groove adjacent the outer surface of the outer tube.

14. A yarn carrier according to claim 13 wherein the outer surface of the inner tube comprises ribs for securing the outer tube to the inner tube.

15. A yarn carrier according to claim 13 wherein the inner tube comprises plastic, metal, wood, or combinations thereof.

16. A yarn carrier according to claim 13 wherein the outer tube comprises paper.

17. A yarn carrier according to claim 16 wherein the outer tube has a thickness and the composition of the paper varies along the thickness of the outer tube.

18. A yarn carrier according to claim 17 wherein the outer tube has an inside portion and an outside portion and the inside portion is softer than the outside portion.

19. A yarn carrier according to claim 13 wherein the hole of the inner tube has side surfaces that are substantially perpendicular to the longitudinal axis.

* * * * *

UNITED STATES PATENT AND TRADEMARK OFFICE

CERTIFICATE OF CORRECTION

PATENT NO. : 7,240,875 B2
APPLICATION NO. : 10/685976
DATED : July 10, 2007
INVENTOR(S) : Ismael A. Hernandez et al.

It is certified that error appears in the above-identified patent and that said Letters Patent is hereby corrected as shown below:

In Column 10
At line 66, change “been would” to --been wound--
At line 67, change “no the carrier” to --on the carrier--

In Column 11
At line 10, change “may be would” to --may be wound--

In Column 12
At line 56, change “1508” to --2508--

In Column 13
At line 35, change “the grove” to --the groove--

In Column 14
At line 7, change “our without” to --or without--

Signed and Sealed this

Twenty-fifth Day of December, 2007

JON W. DUDAS
*Director of the United States Patent and Trademark Office*